US008708435B2

(12) United States Patent
Johnson et al.

(10) Patent No.: US 8,708,435 B2
(45) **Date of Patent: *Apr. 29, 2014**

(54) UPPER DRAWER INSERT

(75) Inventors: Ross Johnson, Jenison, MI (US); Cheryl Compton, Grand Haven, MI (US); Harold R. Wilson, Holland, MI (US)

(73) Assignee: Haworth, Inc., Holland, MI (US)

( * ) Notice: Subject to any disclaimer, the term of this patent is extended or adjusted under 35 U.S.C. 154(b) by 36 days.

This patent is subject to a terminal disclaimer.

(21) Appl. No.: 13/343,404

(22) Filed: Jan. 4, 2012

(65) Prior Publication Data

US 2013/0169133 A1 Jul. 4, 2013

(51) Int. Cl.
*A47B 88/00* (2006.01)

(52) U.S. Cl.
USPC ..... 312/330.1

(58) Field of Classification Search
USPC ..... 312/298, 299, 301, 308, 311, 330.1, 312/331, 333, 334.1, 334.7, 334.19, 402, 312/404
See application file for complete search history.

(56) References Cited

U.S. PATENT DOCUMENTS

| | | | | | |
|---|---|---|---|---|---|
| 128,439 | A * | 6/1872 | Unna | 312/204 |
| 591,134 | A * | 10/1897 | Howard | 312/331 |
| 657,809 | A * | 9/1900 | Beebe | 312/331 |
| 1,061,646 | A | 5/1913 | Welliver | |
| 2,319,555 | A * | 5/1943 | Premo | 384/19 |
| 3,588,198 | A * | 6/1971 | Stewart | 384/18 |
| 4,595,247 | A * | 6/1986 | Zank | 312/334.19 |
| 4,993,786 | A | 2/1991 | DeGiulio | |
| 5,044,059 | A * | 9/1991 | De Giulio | 29/401.1 |
| 5,088,801 | A | 2/1992 | Rorke et al. | |
| 5,211,461 | A | 5/1993 | Teufel et al. | |
| 5,322,365 | A | 6/1994 | Teufel et al. | |
| 5,761,786 | A | 6/1998 | Simons | |
| 6,036,291 | A * | 3/2000 | Rock | 312/333 |
| 6,158,103 | A | 12/2000 | Grubb | |
| 7,168,773 | B1 | 1/2007 | Emary | |
| 7,216,412 | B2 | 5/2007 | Vance | |
| 7,275,797 | B2 | 10/2007 | Timmermann et al. | |
| 7,594,707 | B2 * | 9/2009 | Kunkle et al. | 312/402 |
| 7,740,331 | B2 * | 6/2010 | Koo | 312/404 |
| 7,914,093 | B2 * | 3/2011 | Huang | 312/333 |
| 2006/0260353 | A1 * | 11/2006 | Uihlein et al. | 62/441 |
| 2009/0045708 | A1 * | 2/2009 | Dominique | 312/301 |

FOREIGN PATENT DOCUMENTS

| | | | |
|---|---|---|---|
| EP | 0306701 | A2 | 3/1989 |

* cited by examiner

*Primary Examiner* — Matthew Ing
(74) *Attorney, Agent, or Firm* — Warner Norcross & Judd LLP

(57) ABSTRACT

An insert drawer arrangement attachable to an existing drawer of a file cabinet to define a raised second storage compartment. The arrangement includes an insert drawer provided with end panels which are disposed sidewardly adjacent separate mounting panels, the latter being mounted on the end walls of the existing drawer. The sidewardly adjacent end and mounting panels have a horizontal guide structure cooperating therebetween to enable the insert drawer to be horizontally moved from a first position superimposed over the existing drawing into a second position wherein it is cantilevered outwardly beyond the existing drawer to permit access to the interior of the existing drawer.

16 Claims, 37 Drawing Sheets

UPPER DRAWER INSERT

CROSS REFERENCE TO RELATED APPLICATION

This application is related to co-pending application titled DRAWER INSERT FOR A FILE CABINET, filed concurrently herewith Ser. No. 13/343,122, the disclosure of which is incorporated herein by reference.

FIELD OF THE INVENTION

This invention relates to a drawer arrangement for a cabinet structure and, more specifically, to an improved drawer insert which can be fitted to an existing cabinet drawer for converting the existing drawer into two shallower storage compartments or drawers which are relatively telescopically movable between a stacked position wherein the two shallow storage compartments are disposed generally one above the other, and a horizontally extended position wherein the drawer storage compartments are horizontally offset to facilitate vertical access thereto.

BACKGROUND OF THE INVENTION

Cabinet structures employing one or more horizontally-openable drawers are extensively utilized in offices and similar environments for storage of files, papers, and miscellaneous other objects. Such cabinet structures, including those referred to as "lateral files", generally provide a plurality of horizontally-openable drawers which individually have an upwardly-opening box-shaped structure defining a storage compartment. In many instances the box-shaped drawers are fairly deep, particularly those which are designed for storage of files and similar papers. However, the storage needs of a user may vary over time, and the user's storage needs may be such as to require fewer deep-compartment drawers since the articles being stored may be more suitable for shallow compartment drawers. While various adaptor structures are available for disposition within a drawer to create various storage levels or compartments, such adaptors typically do not permit convenient access to articles stored below the adaptor without requiring removal of the adaptor or, in the alternative, the adaptor is not effective for providing storage and/or access to the entire horizontal interior of the compartment over multiple levels.

Accordingly, it is an object of this invention to provide an improved drawer insert assembly for an existing drawer, which insert assembly includes an insert drawer which is of shallower depth than the existing drawer and which sits on and within the upper portion of the existing drawer compartment in a generally vertically stacked relationship so as to define two vertically-stacked shallow storage compartments, an upper one defined in the insert drawer, and a lower one defined by the original drawer storage compartment.

It is a further object of the invention to provide a drawer insert assembly, as aforesaid, which mounts on the existing drawer in such manner as to permit horizontal sliding movement of the insert drawer between a normal stacked storage position wherein the insert drawer is readily accessible when the original drawer is in an open position, with the insert drawer also being horizontally slidably extendible rearwardly into the interior of the cabinet to permit ready access to a lower storage compartment defined by the original drawer.

It is also an object of this invention to provide an improved insert for an existing drawer, as aforesaid, which insert includes an insert drawer which is of shallower depth and fits within the original drawer compartment in upwardly spaced relation from the bottom wall thereof. The insert drawer is horizontally slidably mounted on end panels which are mounted, preferably by a resilient snap engagement, on the side walls of the main box structure of the existing drawer. The slidable mounting permits the insert drawer to be manually slidably moved between a primary position wherein it is disposed entirely over the bottom wall of the main box structure, and a secondary position wherein the insert drawer is cantilevered horizontally outwardly a significant distance beyond an edge of the bottom wall of the main box structure.

It is a still further object of the invention to provide a drawer insert assembly, as aforesaid, which can be easily and effectively retrofitted to an existing drawer without requiring structural modification or reconstruction of the original cabinet drawer, and which permits retrofitting of the drawer insert assembly to the existing drawer in a simple and efficient manner without requiring use of complex tools or equipment.

In accordance with the present invention, there is initially provided a conventional drawer arrangement having at least one upwardly opening drawer supported on a cabinet and horizontally movable from a closed position wherein the drawer front closes off a front opening of the cabinet, and an open position wherein the drawer projects horizontally outwardly of the cabinet so that a vertically deep storage compartment defined by the drawer is vertically accessible. The original or existing drawer typically includes an upwardly-opening box structure defined by a bottom wall which extends between parallel upright end walls, the latter typically mounting horizontal slide arrangements which couple to the cabinet side walls, a drawer front which typically joins to front edges of the end walls, such as by screws cooperating between opposed abutting flanges, and an upright rear wall projecting upwardly from the bottom wall and extending horizontally between rear edges of the end walls. This rear wall frequently has a height which is significantly less than the height of the end walls. A drawer insert arrangement according to the present invention is mounted to the existing drawer specifically by being mounted on the end walls of the existing drawer and supported to extend horizontally therebetween in parallel relationship to the sideward extent of the existing drawer. The drawer insert arrangement defines an insert drawer having a storage compartment with a bottom disposed a substantial upwardly-spaced distance above the bottom wall of the existing drawer. The insert drawer arrangement includes mounting panel structures disposed at opposite ends of the insert drawer which mount on the existing drawer end walls and which also provide a horizontal movable support for the insert drawer, preferably by means of a track-and-roller support arrangement, so that the insert drawer can be moved horizontally forwardly/rearwardly relative to the existing drawer, with the insert drawer normally being disposed in direct upward spacing above the original drawer bottom wall, but being horizontally movable rearwardly away from the drawer front so that the insert drawer is cantilevered rearwardly into the interior of the cabinet housing to permit vertical access to the original drawer storage compartment as defined directly above the original bottom wall.

With the improved drawer insert arrangement of this invention, as briefly summarized above, a single deep-compartment drawer can be easily converted into a dual-drawer arrangement so as to provide two readily-accessible shallower drawer compartments, which conversion can be effected during manufacture if desired, but more significantly can be easily converted at a use location by assembling and mounting the insert drawer arrangement to the original drawer box structure, which assembling and mounting can be carried out without requiring special tools or difficult manipulations.

Other objects and purposes of the invention will be apparent to persons familiar with structures of this general type upon reading the following specification and inspecting the accompanying drawings.

Figure 1:
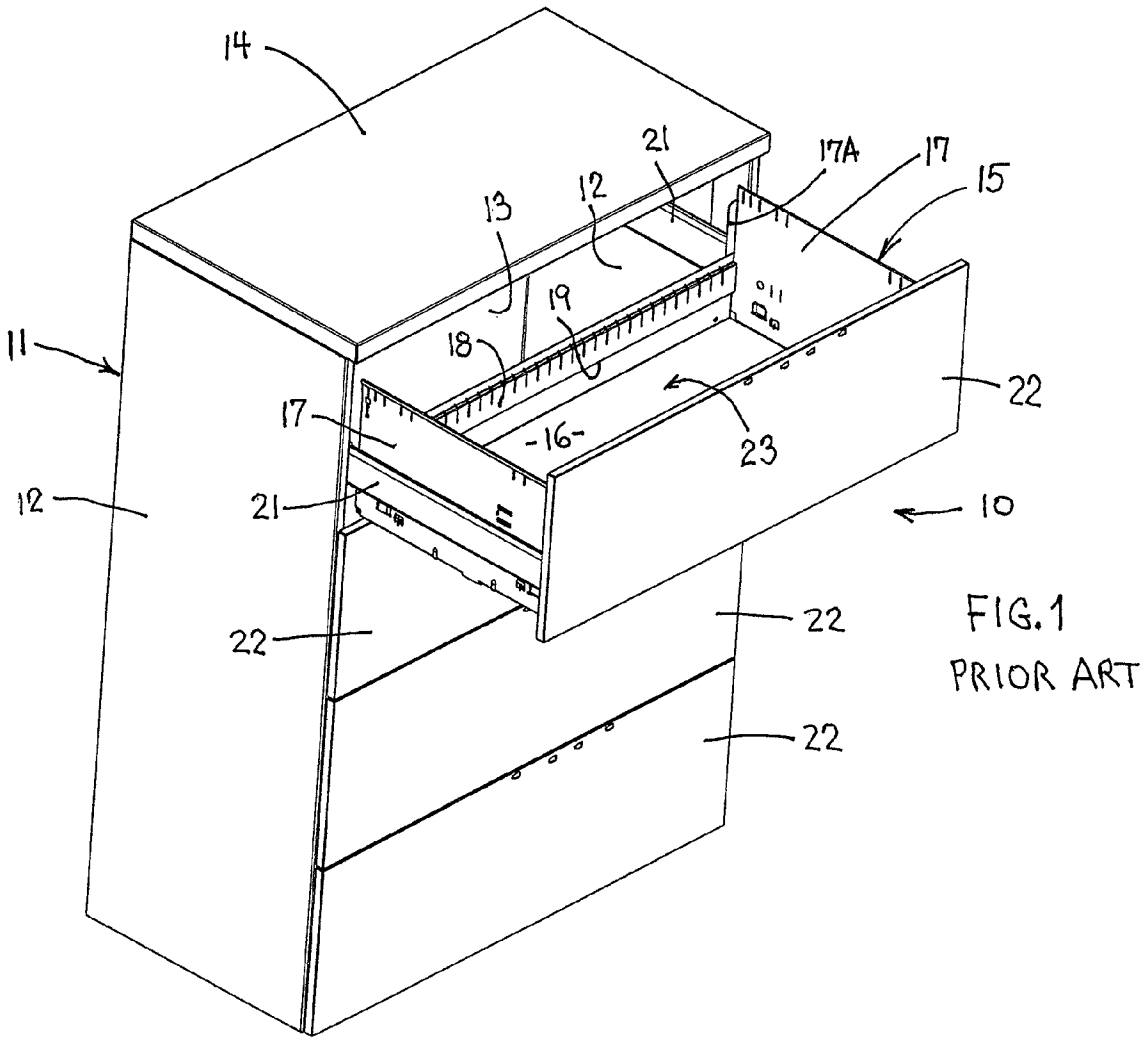
FIG. 1 PRIOR ART
FIG. 1 is a perspective view of a conventional multiple-drawer file cabinet, known as a lateral file, and showing the upper drawer in its fully extended or open position.
Figure 2:
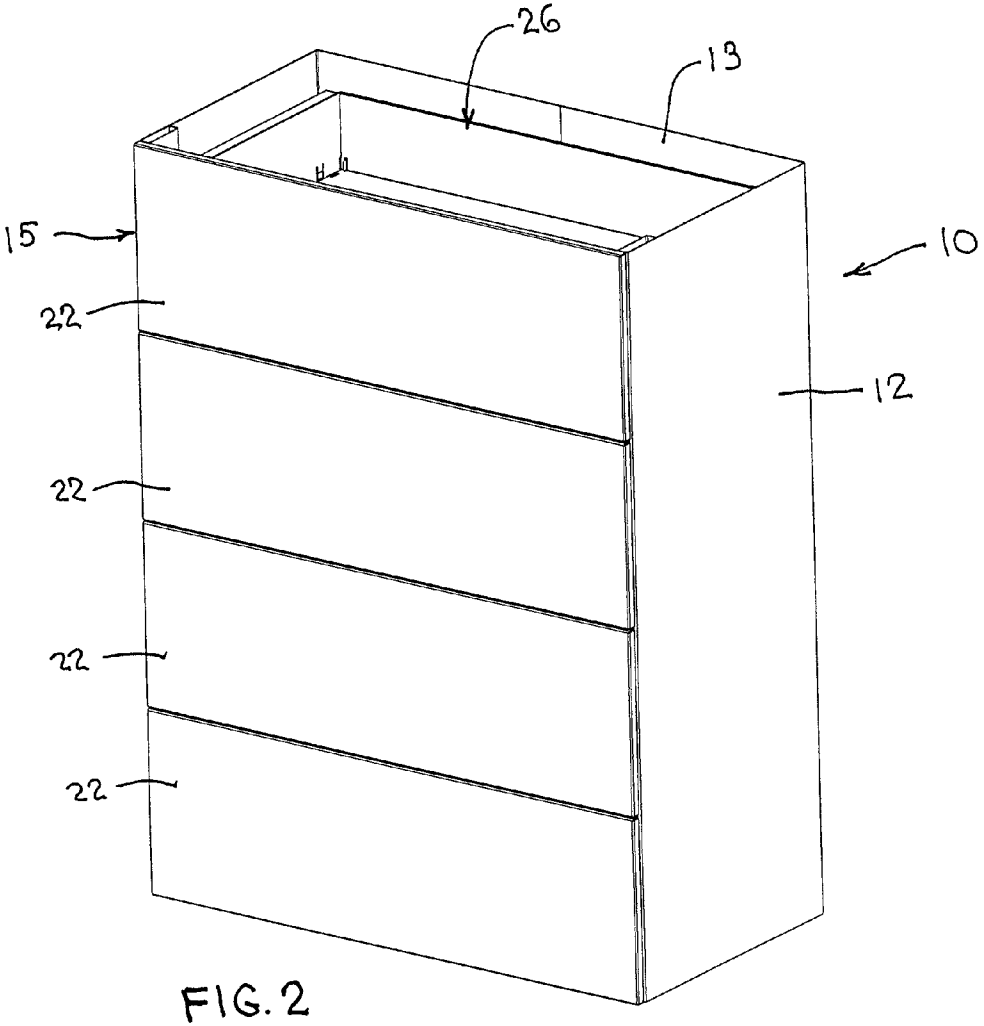
FIG. 2 is a perspective view showing a conventional multiple-drawer cabinet similar to FIG. 1, the top wall being removed for purposes of illustration, and the top drawer being shown in its closed position but converted so as to mount a drawer insert arrangement thereon in accordance with a first embodiment of the present invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the structure and designated parts thereof. The words "inward" and "outward" will also refer to directions of drawer movement, these respectively being movement of the existing drawer in closing and opening directions. The terminology will include the words specifically mentioned, derivatives thereof, and words of similar import.

DETAILED DESCRIPTION

Referring initially to FIG. 1, there is illustrated a conventional drawer or file cabinet 10, referred to as a lateral file, defined by a cabinet housing 11 having upright side walls 12 rigidly joined by a back wall 13, a top wall 14 and a bottom wall (not shown). The cabinet mounts a plurality of horizontally-openable cabinet drawers 15, one shown in the horizontally extended open position.

Figure 6:
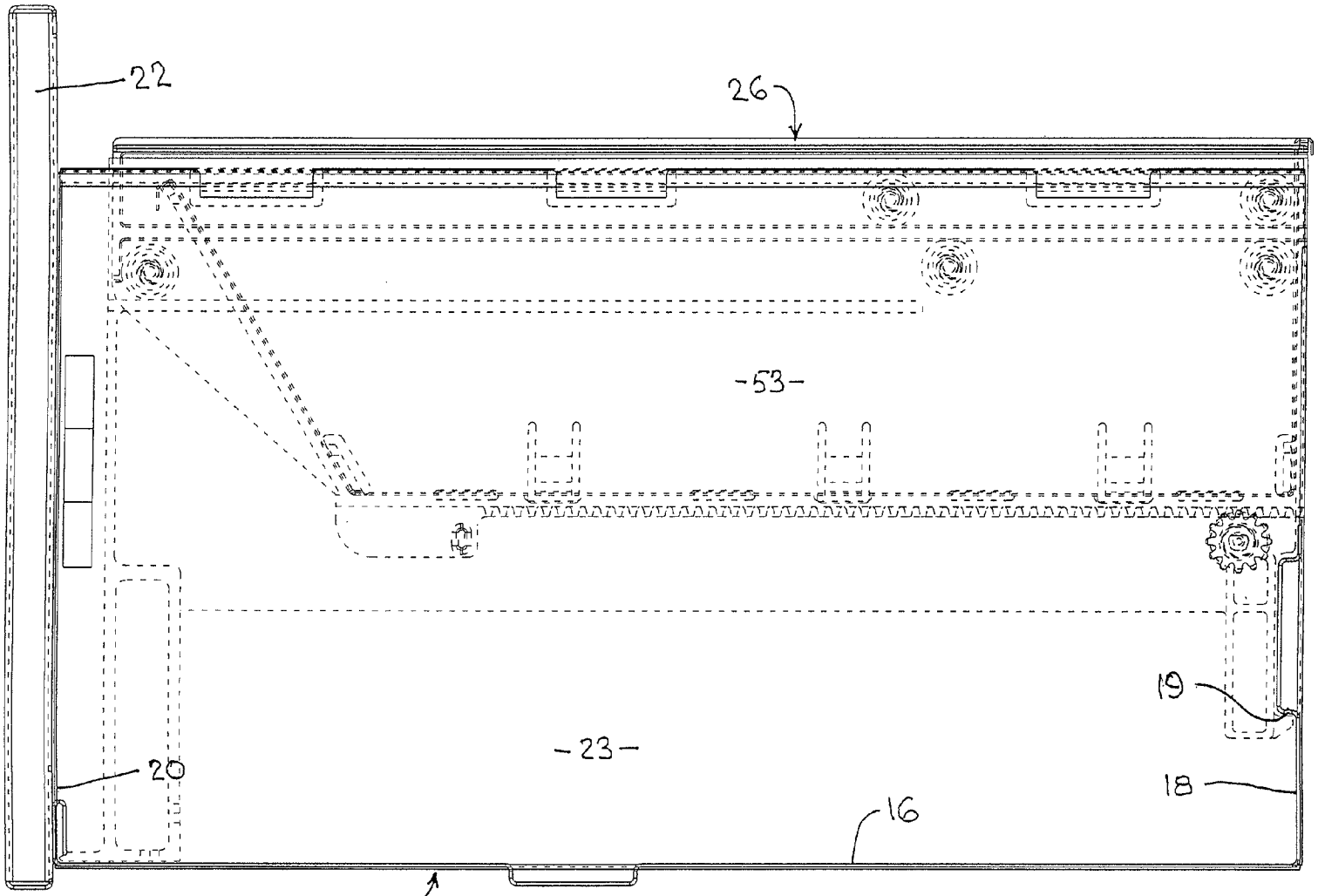
FIG. 6 is a side elevational view showing solely a single existing drawer as detached from the cabinet, and illustrating the drawer insert arrangement mounted on the existing drawer and disposed in its telescopically stored position wherein it is disposed entirely within the interior of the original cabinet drawer.
Figure 7:
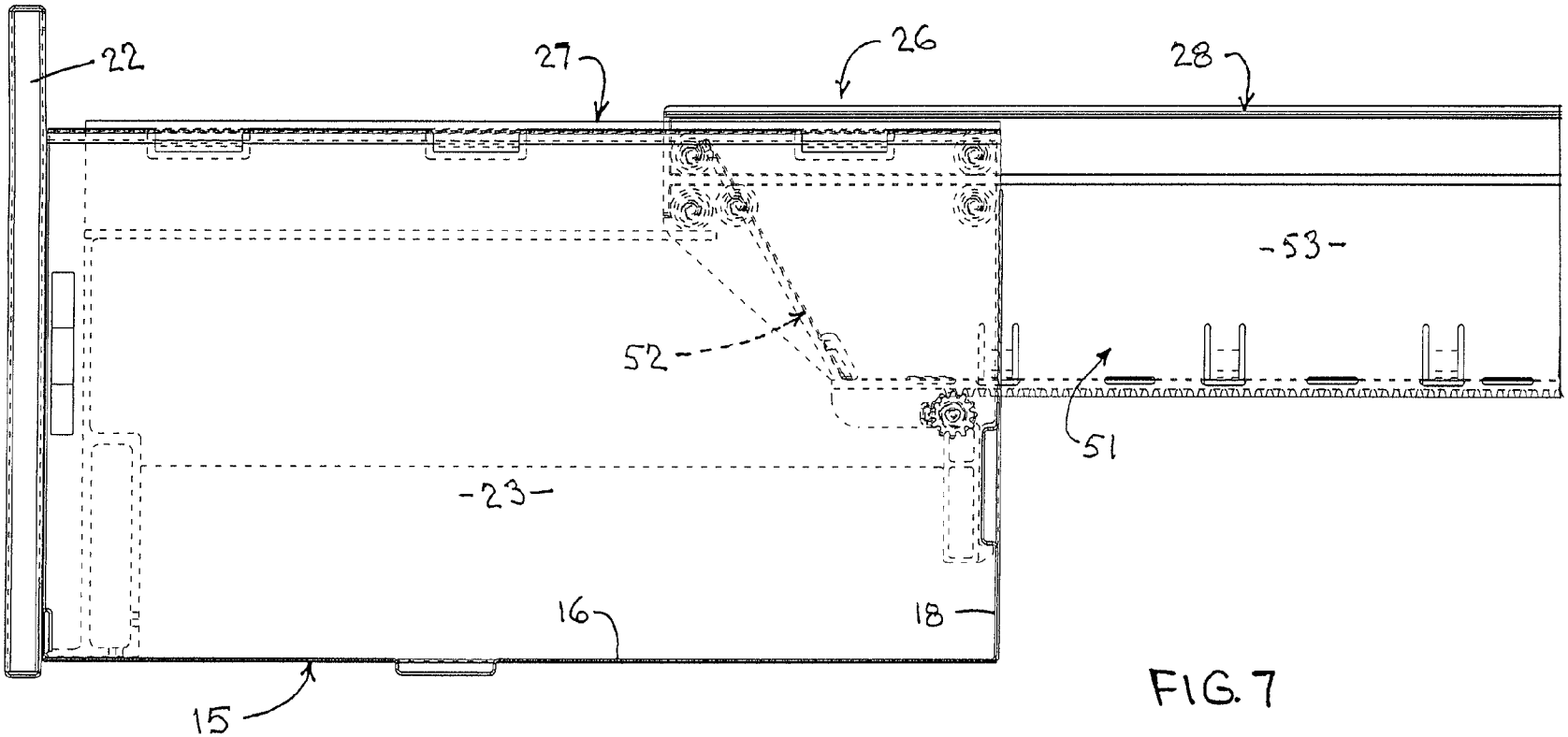
FIG. 7 is a side elevational view which corresponds to FIG. 6 but illustrates the insert drawer horizontally displaced rearwardly (i.e. outwardly) so as to be disposed in a rearward cantilevered or overhanging relationship from the rear of the original cabinet drawer to permit vertical access to the storage compartment defined in the bottom region of the original cabinet drawer.
Figure 8:
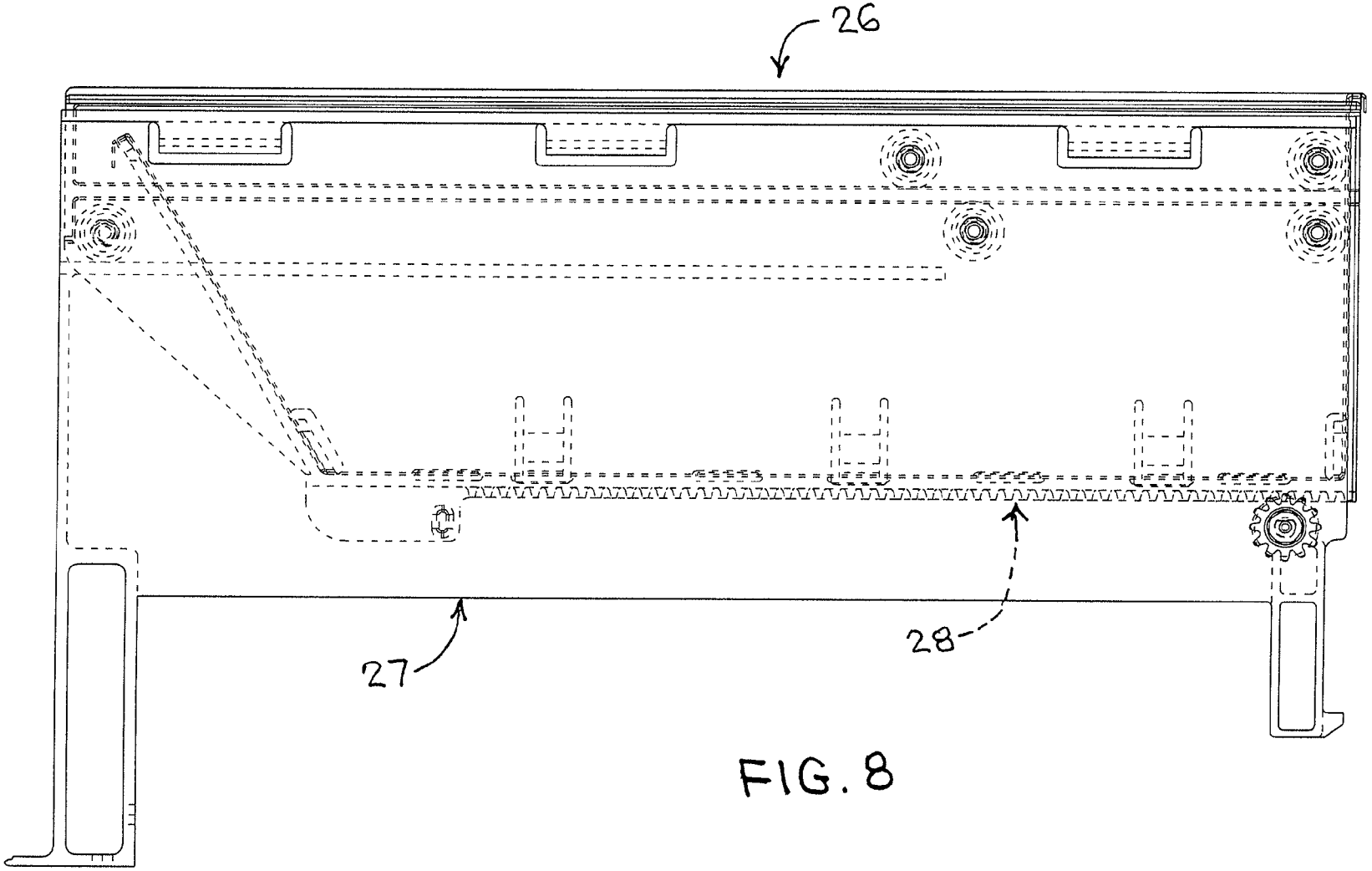
FIG. 8 is a side elevational view of solely the insert drawer arrangement in its assembled and normal storage position, which normal storage position corresponds to the relationship illustrated in FIG. 6.
Figure 9:
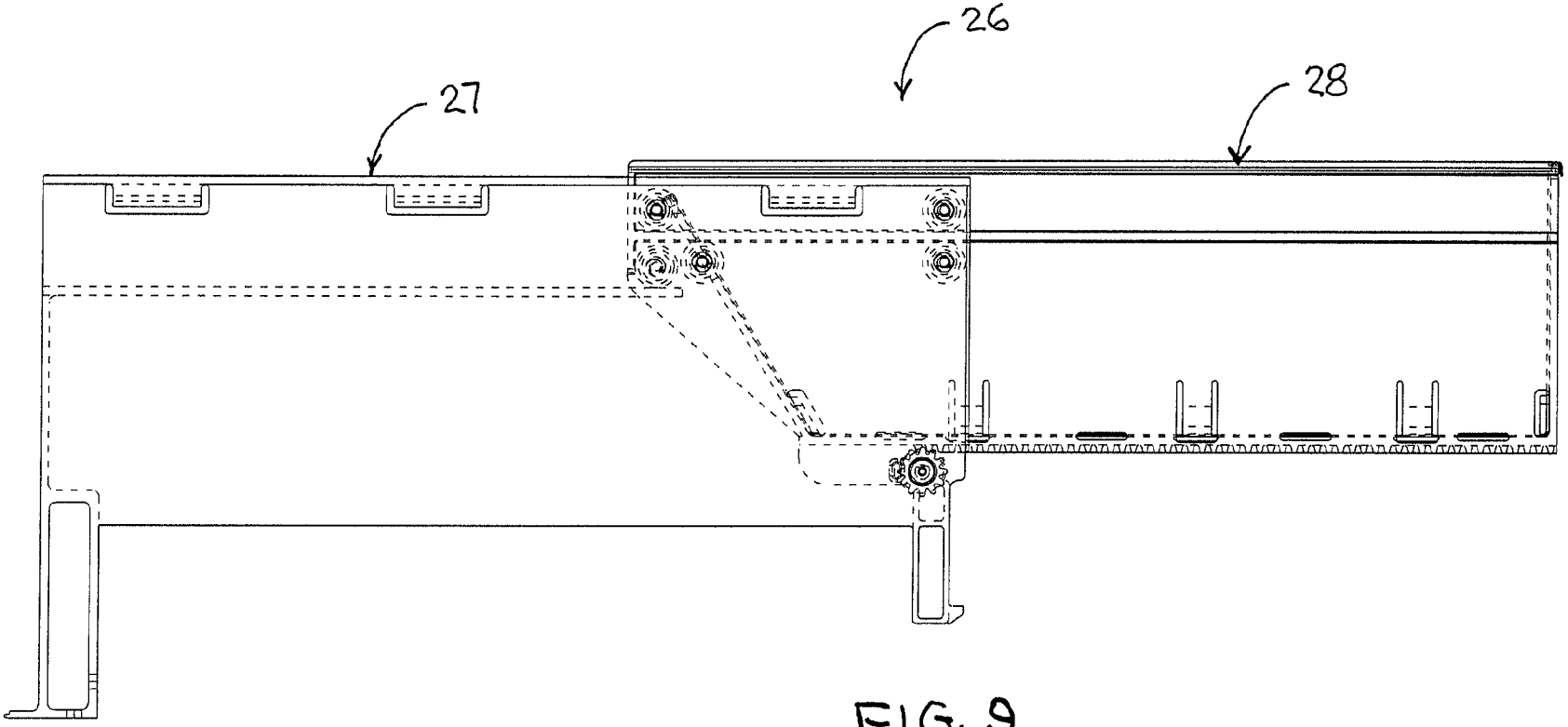
FIG. 9 is a side elevational view of the assembled drawer insert arrangement corresponding to FIG. 8, but showing the insert drawer in its rearward or cantilevered extended position corresponding to the relationship illustrated by FIG. 7.
Figure 10:
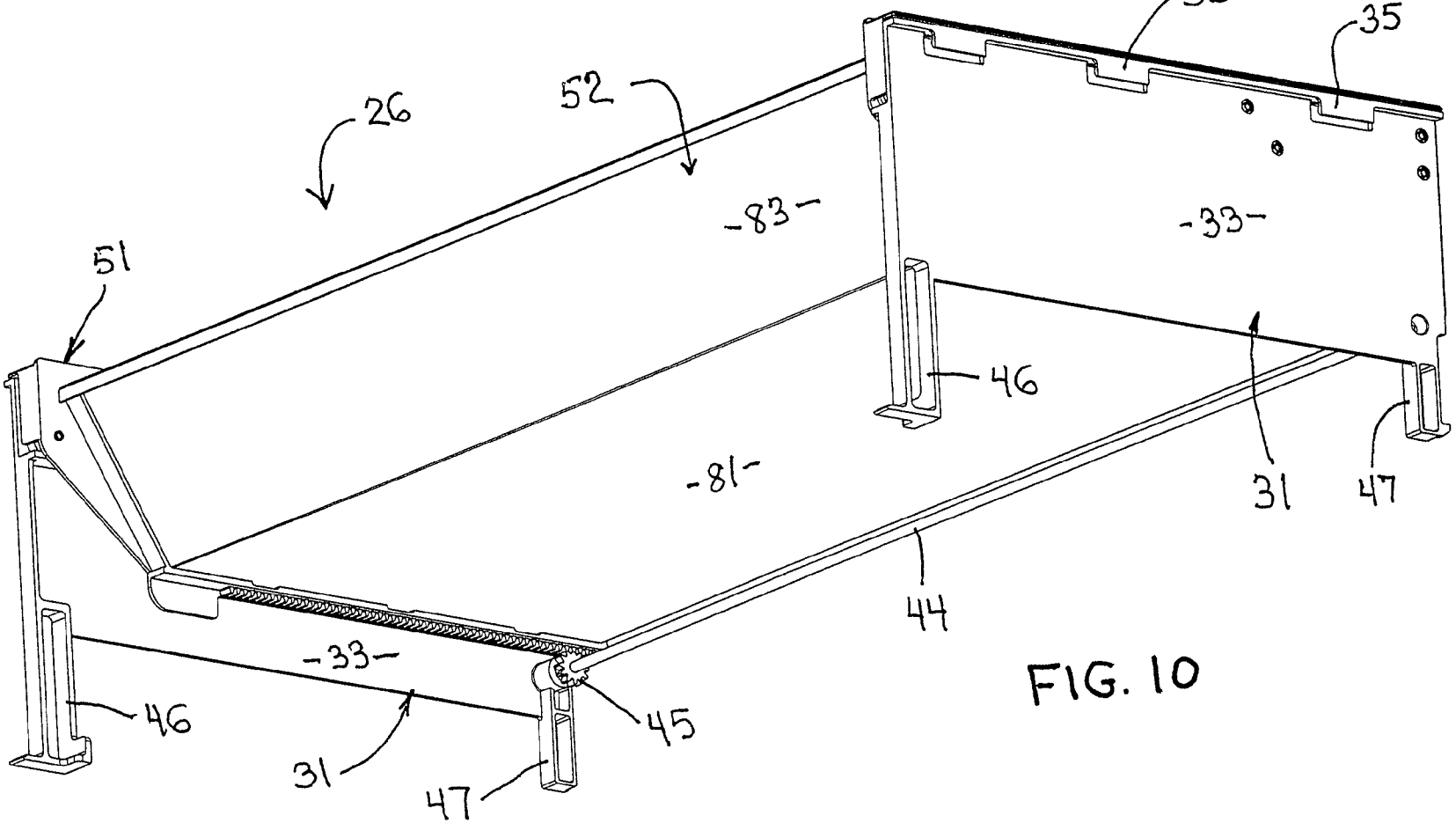
FIG. 10 is a perspective view, angled upwardly from below, of the assembled insert drawer arrangement when in the compact storage position corresponding to FIG. 8.
Figure 11:
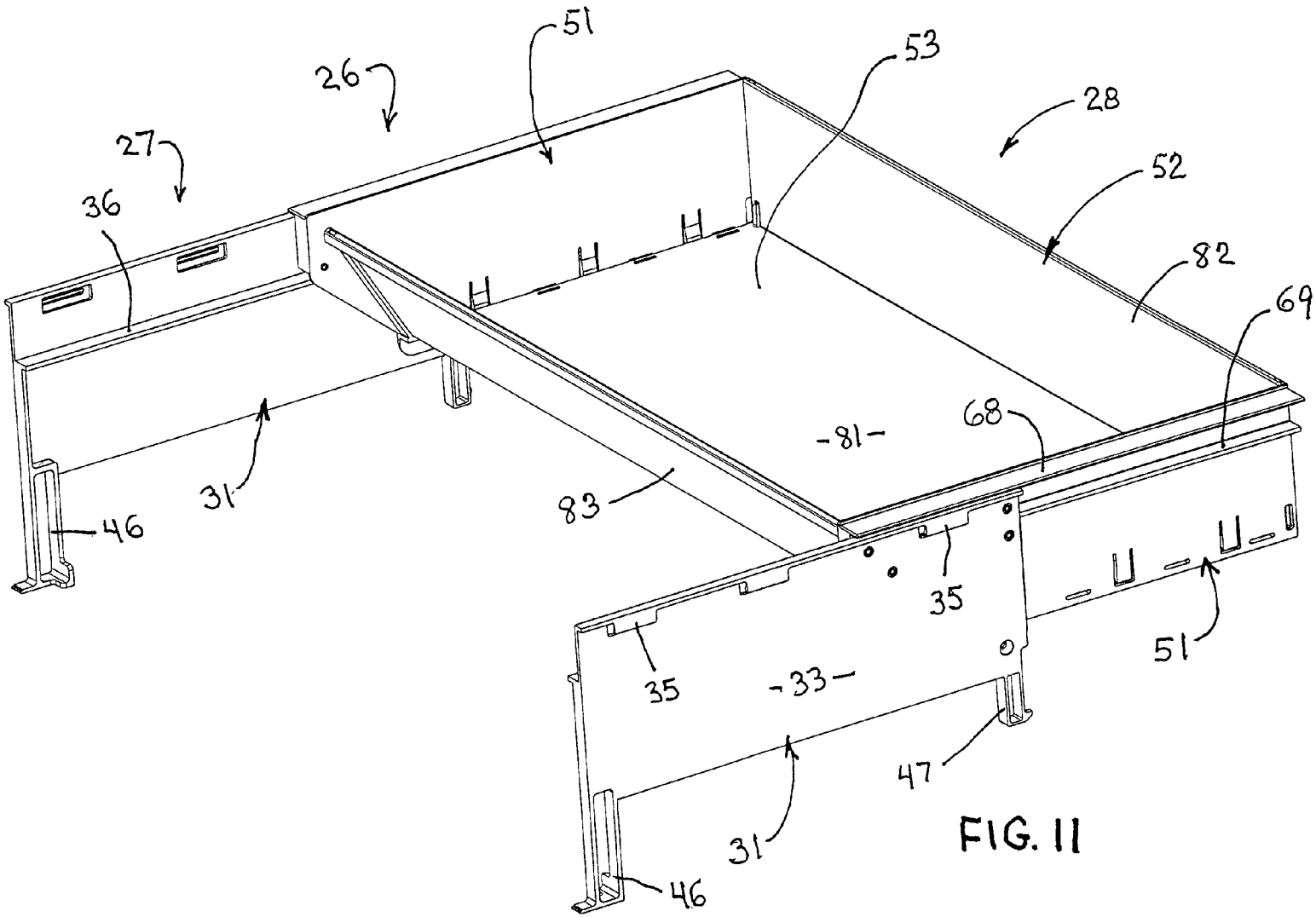
FIG. 11 is an upper perspective view of the assembled insert drawer arrangement showing the latter when the insert drawer is in its rearward cantilevered or extended position corresponding to the relationship illustrated in FIG. 9.

The cabinet drawer 15 is formed generally as an upwardly opening box structure defined by a bottom wall 16 which, in the illustrated construction, has a reinforcing channel extending in the lengthwise extent thereof. A pair of plate-like side or end walls 17 are fixed to and project upwardly from opposite ends of the bottom wall 16 in generally parallel relationship, and are rigidly joined by a lower-height rear wall 18 (FIG. 6) which extended horizontally therebetween and joins to edge flanges 17A associated with the side walls 17. This rear wall 18 in the illustrated environment has a generally Z-shaped cross section in that the upper portion is offset forwardly from the lower portion, thereby defining a shoulder 19 which faces downwardly of the drawer compartment. An upright front flange 20 (FIG. 6) extends along the front edge of the bottom wall. The side or end walls 17 are typically formed of metal and have a rolled hem along the upper edge thereof. Conventional elongate telescopic ball slide arrangements 21 are secured to the outer sides of end walls 17, which slides project horizontally into the interior of the cabinet for securement to inner sides of the cabinet side walls 12. The telescopic ball slide units 21 permit full extension of the drawer 15 when in the illustrated open position.

The drawer 15 also includes a generally vertical drawer front 22 which closes off a front side of the drawer and is secured to the end walls 17. The resulting structure of the drawer 15, namely the box-shaped upwardly-opening structure thereof, defines therein a storage compartment 23 which opens upwardly from above the bottom wall 16 and is accessible when the drawer is in the illustrated open position.

Examples of known constructions of cabinets of this general type are U.S. Pat. Nos. 7,275,799 and 4,692,984, both owned by the Assignee hereof.

Figure 3:
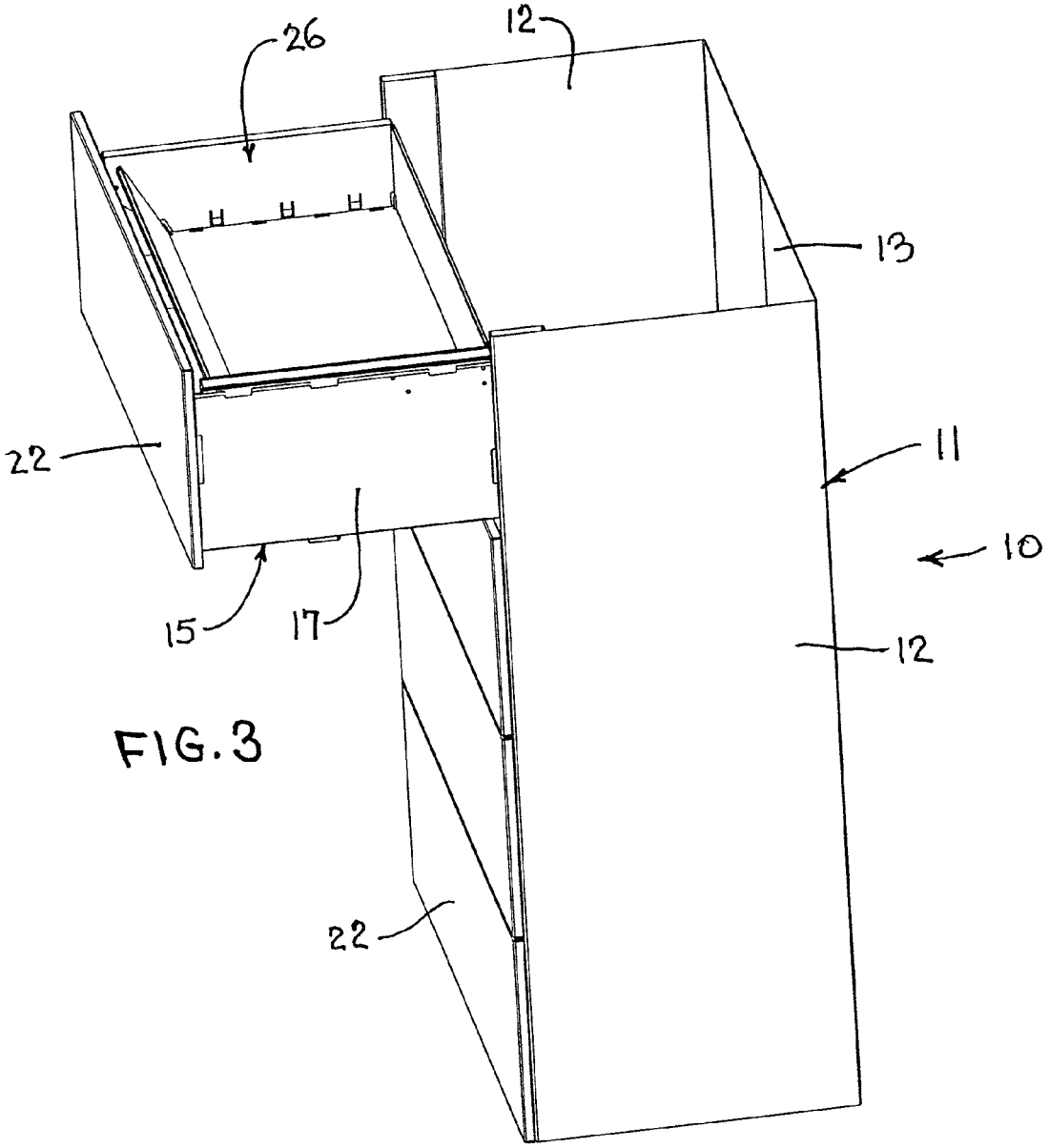
FIG. 3 is a further perspective view of the cabinet of FIG. 2 but showing the existing upper drawer, with the drawer insert arrangement associated therewith, in its extended open position.
Figure 4:
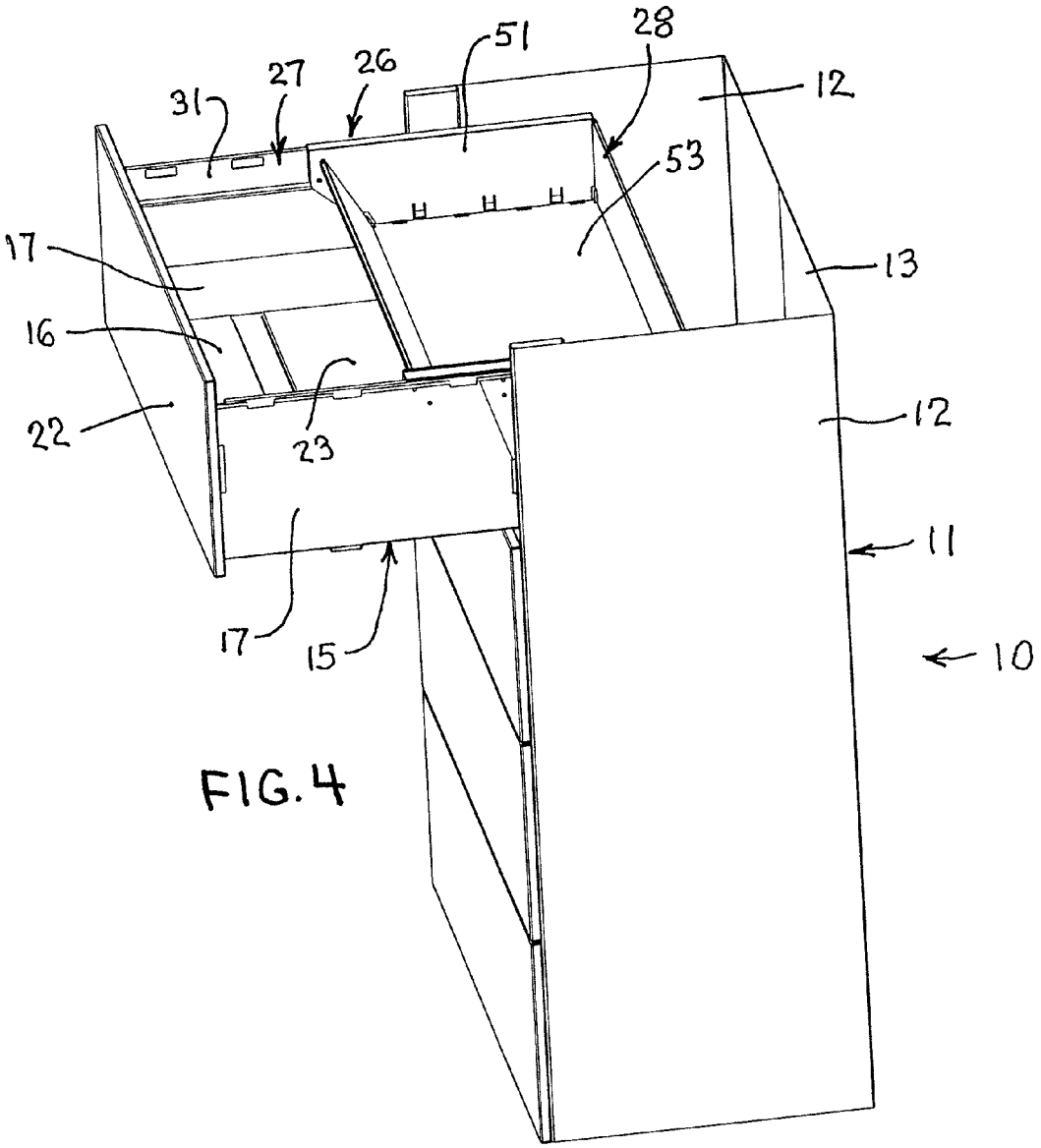
FIG. 4 is a perspective view which corresponds to FIG. 3 and shows the existing top drawer in its extended open position but illustrates the insert drawer in its telescopically extended position projecting partially into the cabinet so as to permit access to a lower storage compartment as defined by the box structure of the existing top drawer.
Figure 5:
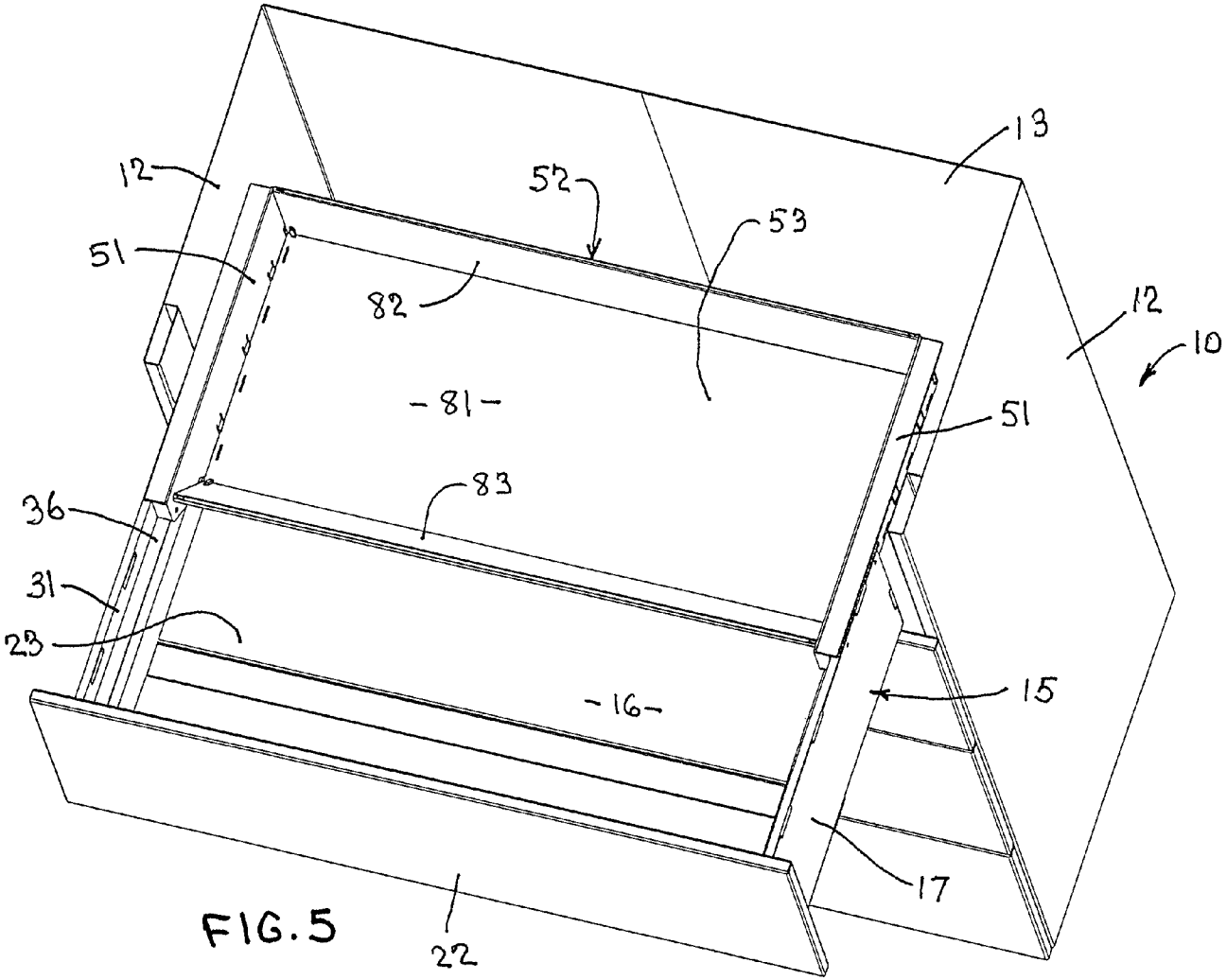
FIG. 5 is a further view which generally corresponds to FIG. 4 but shows the cabinet and specifically the open top drawer from a different perspective.

In accordance with the present invention, and as illustrated by FIGS. 2-7, a first embodiment of a drawer insert arrangement 26 is provided and positioned for structural cooperation with and between the end walls 17 of the existing drawer box structure 15 so as to define an upper secondary shallow storage compartment which is separate from and disposed above a primary storage compartment as defined within the original box structure directly above the bottom wall 16 thereof. The drawer insert arrangement 26 is formed primarily by two assemblies, namely a mounting assembly 27 which fixedly mounts directly to the right and left end walls 17 of the original drawer box structure 15, and a drawer assembly 28 which extends lengthwise of the box structure 15 and at opposite ends coupled to the mounting assembly 27 by means of a horizontal connection which enables an insert drawer 28 to be horizontally moved relative to the original box structure between normal and rearwardly extended positions as illustrated by FIGS. 3 and 4, respectively. With this arrangement, when the existing cabinet drawer is open and the insert drawer 28 is in the normal position illustrated by FIG. 3, the upper shallow storage compartment defined by the insert drawer 28 is readily accessible. When in this latter position, however, the insert drawer 28 can be manually moved rearwardly into the extended position illustrated by FIG. 4, whereby a bottom storage compartment as defined within the original drawer (below the insert drawer) is then readily accessible. In this latter position, the front portion of the insert drawer 28 projects slightly outwardly beyond the front of the cabinet to permit limited access to the upper storage compartment defined therein.

Considering now the construction of the drawer insert arrangement 26, reference will hereinafter be made to FIGS. 12-15 with respect to the mounting assembly 27, and FIGS. 16-20 with respect to the drawer assembly 28.

More specifically, the mounting assembly 27 (FIGS. 12-15) is defined primarily by a pair of mounting panels 31 which are generally parallel upright members disposed in opposed facing relationship on opposite sides of a horizontal centerline 32 which represents the opening/closing direction of the cabinet drawer. The mounting panels 31 are effectively right and left members which are basically mirror images of one another, and each is preferably constructed as a one-piece plastic member by molding or other suitable forming process.

Each mounting panel 31 has a main upright side wall 33 provided with a top flange 34 which extends lengthwise along the upper edge thereof in a generally horizontal orientation, and which is cantilevered horizontally sidewardly through a small extent generally in an outward sideward direction. Flange 34, adjacent the other free edge thereof, joins to a plurality of tabs 35 which are cantilevered downwardly and are disposed in spaced relationship along the lengthwise extent of the top flange 34. The tabs 35, at the lower free edges thereof, have ribs thereon which protrude inwardly toward the side wall 33. These tabs 35 and their cooperation with the top wall 34 and main upright side wall 33 define a generally horizontally elongate channel which opens downwardly. This latter channel allows the upper edge of the box structure end wall 17 to be snapped upwardly and snugly seated therein to permit the mounting panel 31 and specifically the upright side wall 33 thereof to be securely seated directly adjacent and in generally vertical overlying relationship to the inner vertical side surface of the respective box structure end wall 17.

The mounting panel 31, on the opposite or inner vertical side surface thereof, has a horizontally elongate guide flange or rail 36 fixed thereto and cantilevered horizontally outwardly therefrom through a small extent. The guide rail 36 is horizontally elongated and projects from adjacent the front edge of the side wall 33 rearwardly over a majority of the front-to-back width thereof. In the illustrated embodiment, the rear edge of guide rail 36 terminates spaced from the side wall rear edge by a distance which is approximately one-fourth to one-third the overall front-to-back width. This guide rail 36 is disposed at an elevation which is spaced downwardly a small distance below the top flange 36, but is spaced upwardly a greater distance from the lower edge of the side wall 33.

Figure 13:
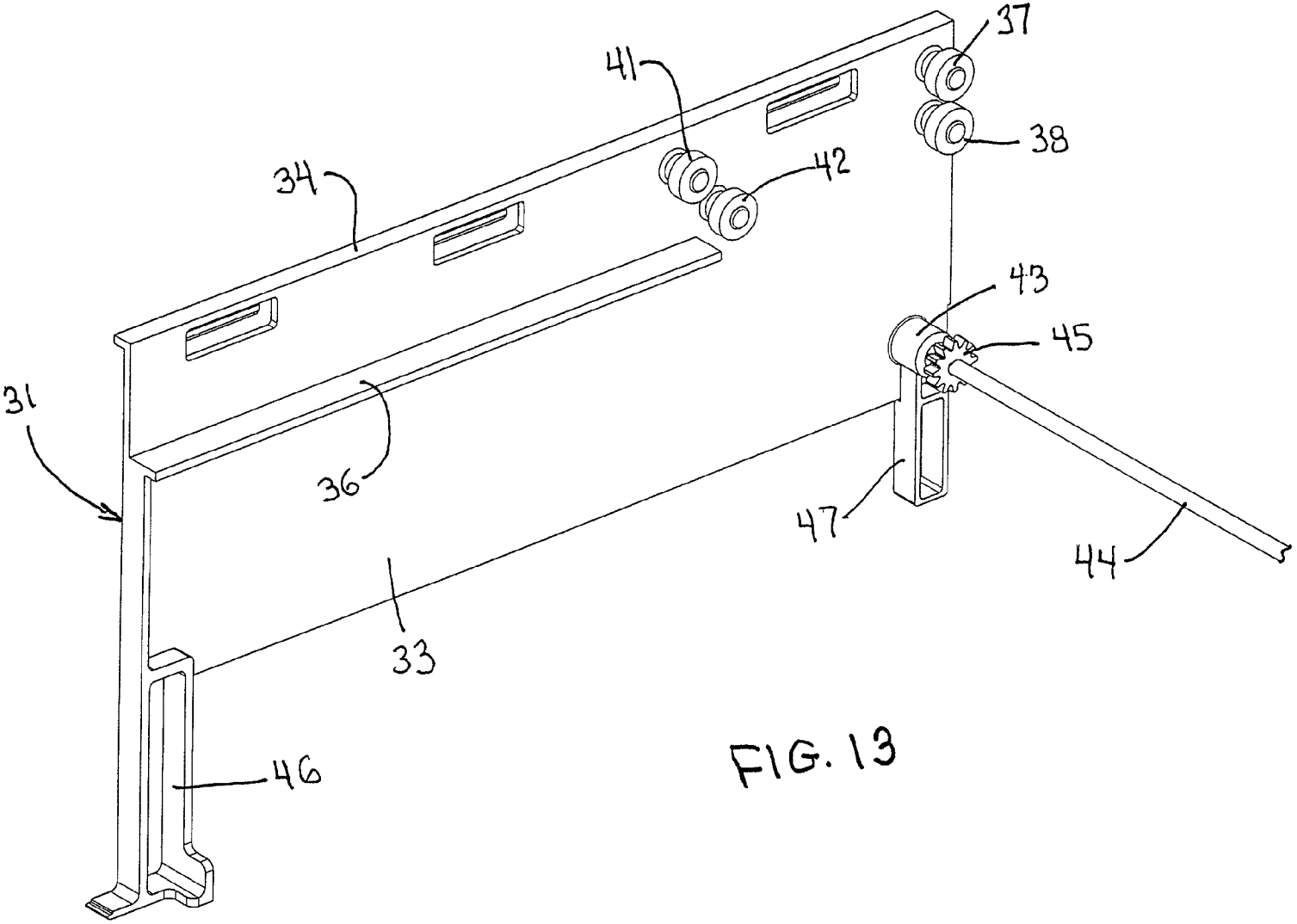
FIG. 13 is a perspective view showing, on an enlarged scale, a fragment of the mounting assembly illustrated in FIG. 12.
Figure 14:
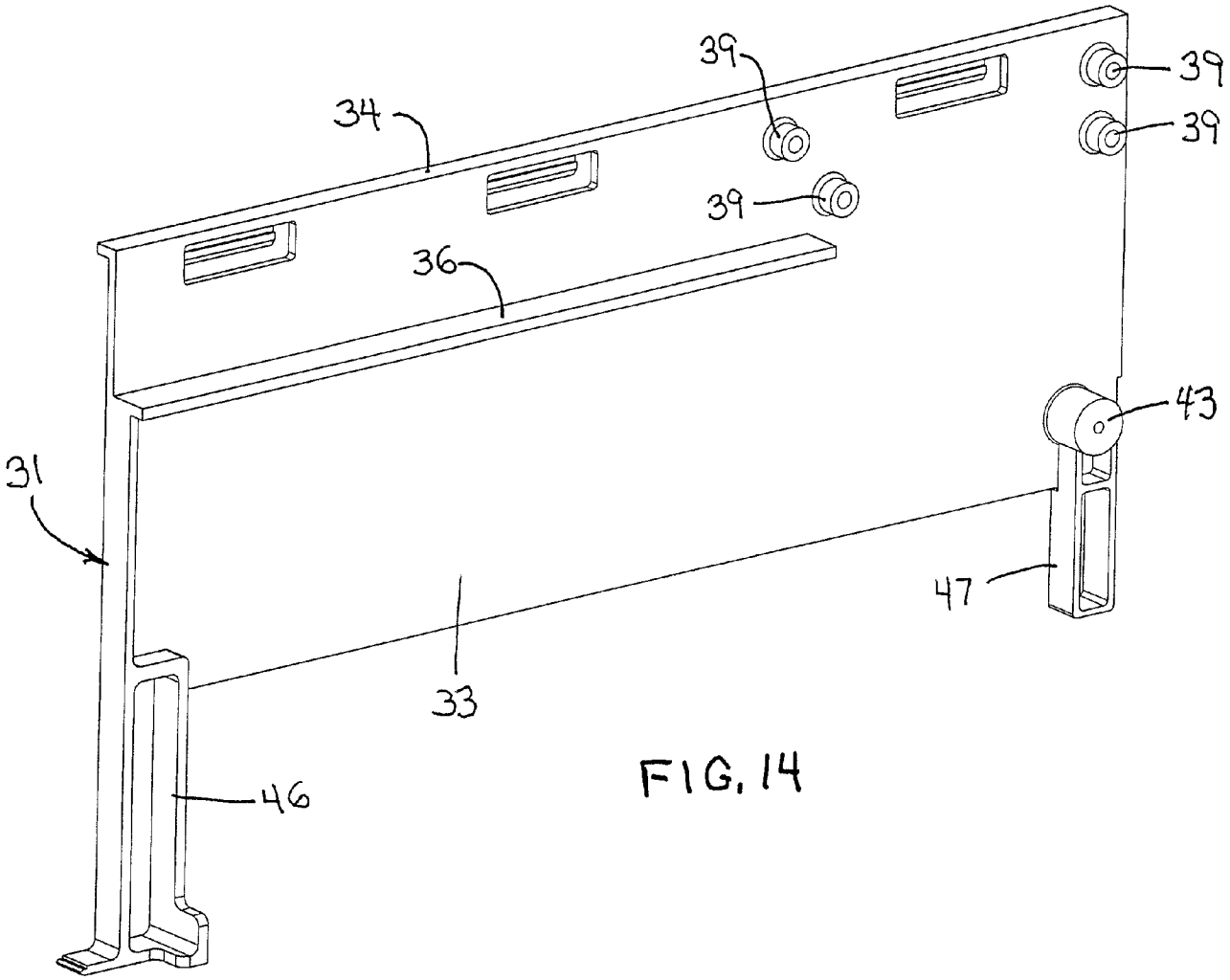
FIG. 14 is a perspective view similar to FIG. 13 but illustrating solely a mounting panel and specifically an inner side thereof.
Figure 15:
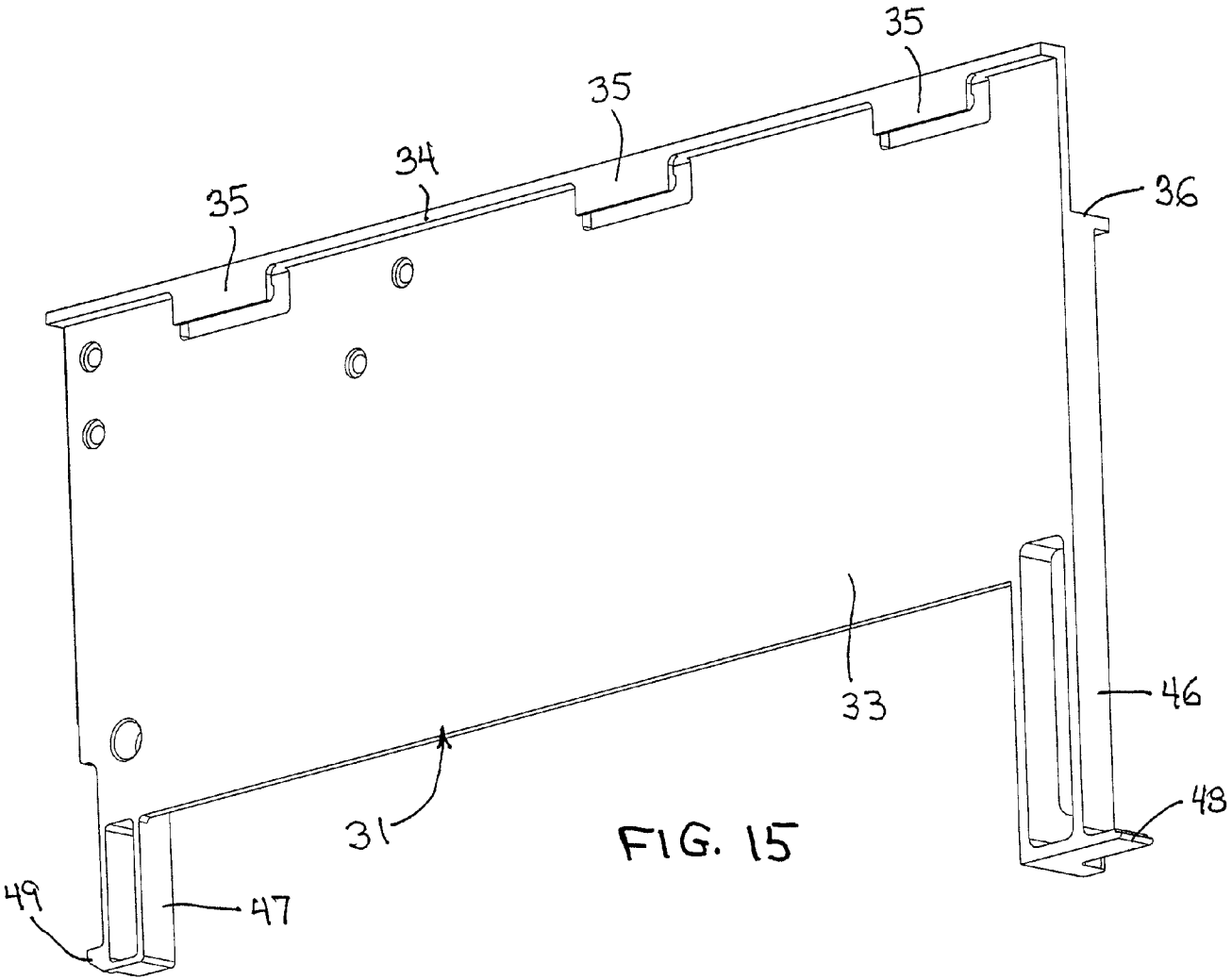
FIG. 15 is a perspective view of the mounting panel illustrated in FIG. 14 but showing the opposite or outer side thereof.
Figure 16:
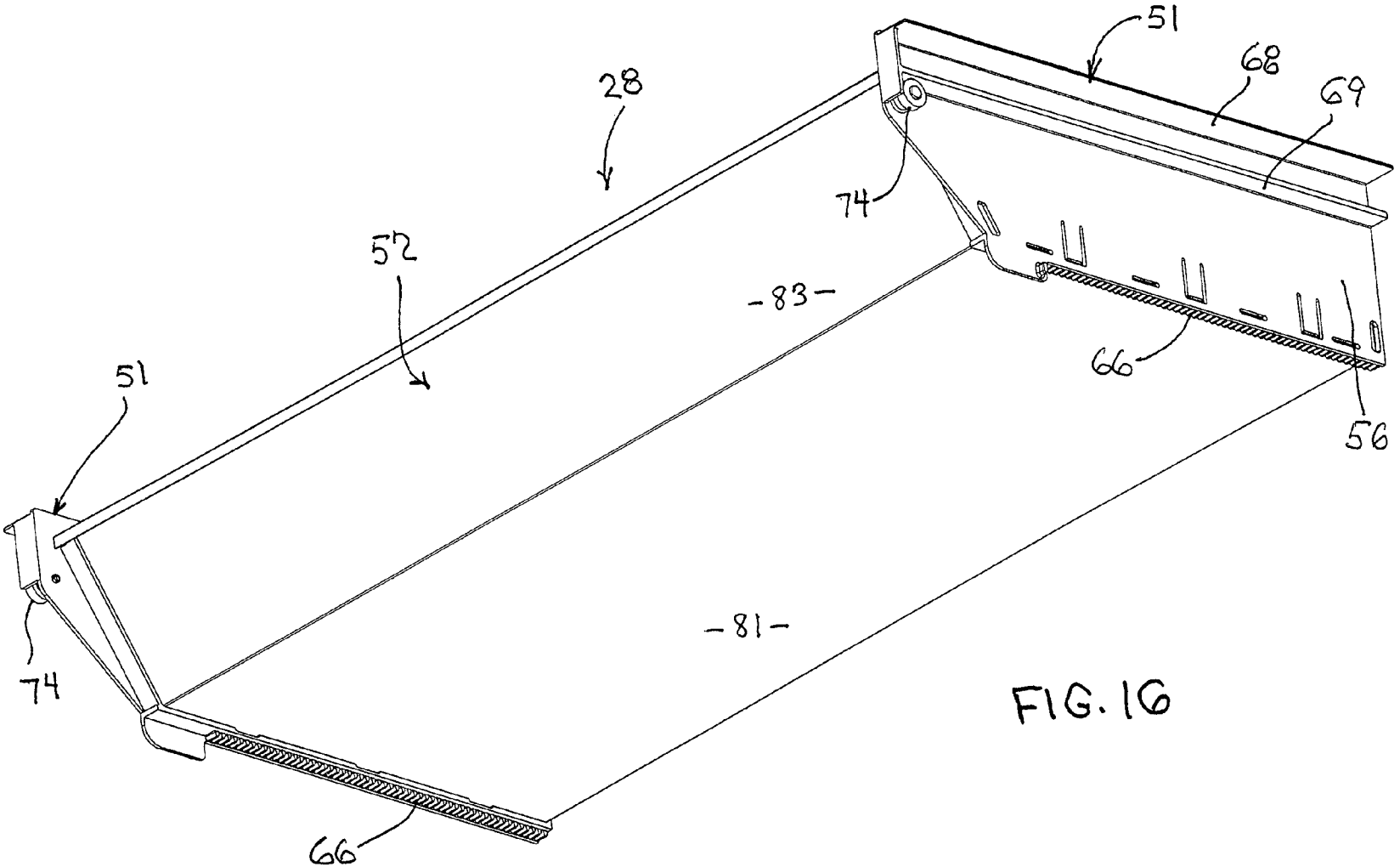
FIG. 16 is a perspective view, taken from below, of the insert drawer and its assembled relationship to end walls which couple to opposite ends of the drawer member.
Figure 17:
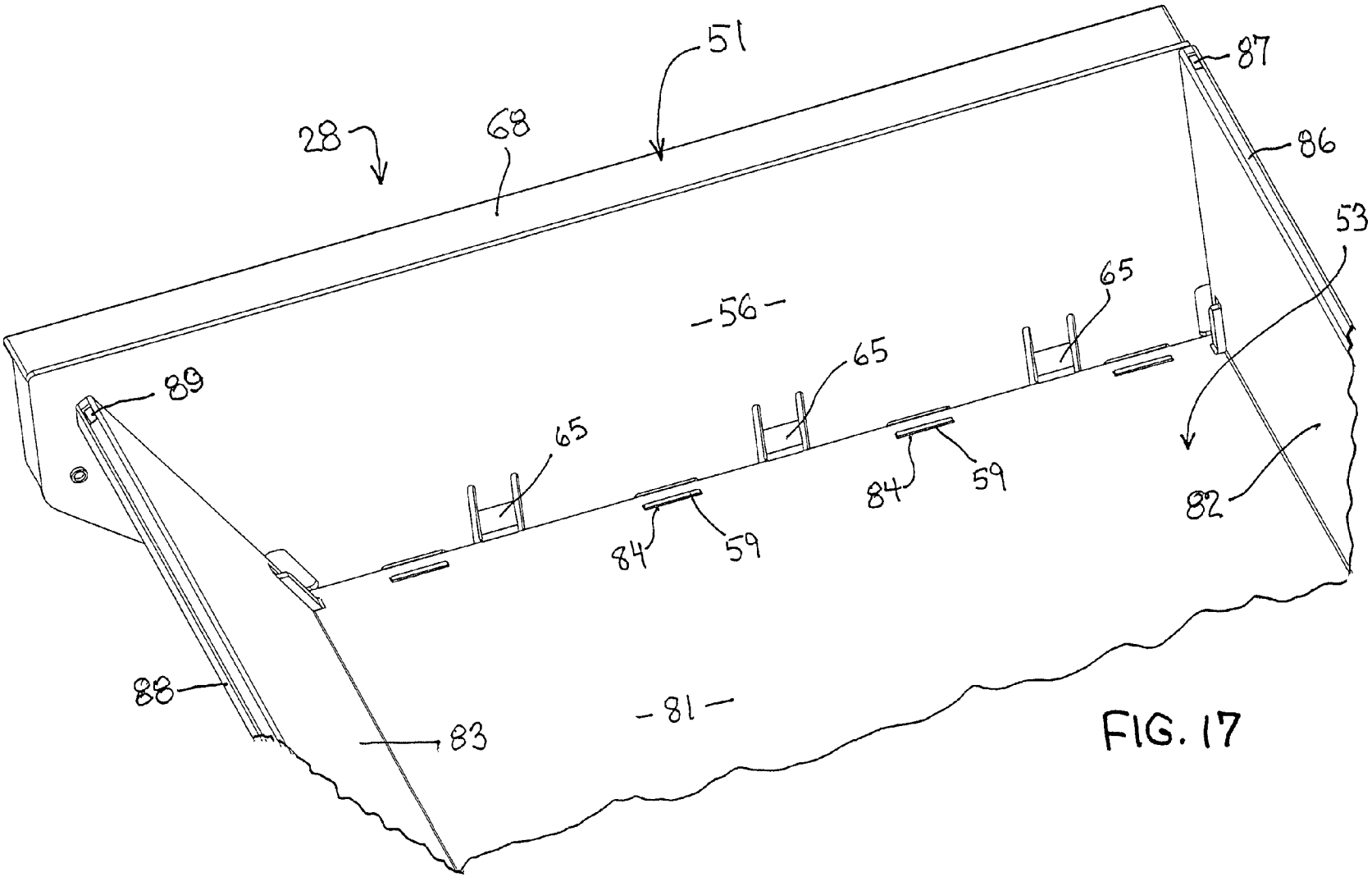
FIG. 17 is an enlarged, fragmentary perspective view showing one end of the assembled insert drawer of FIG. 16, and specifically illustrating the interior adjacent one end thereof.
Figure 18:
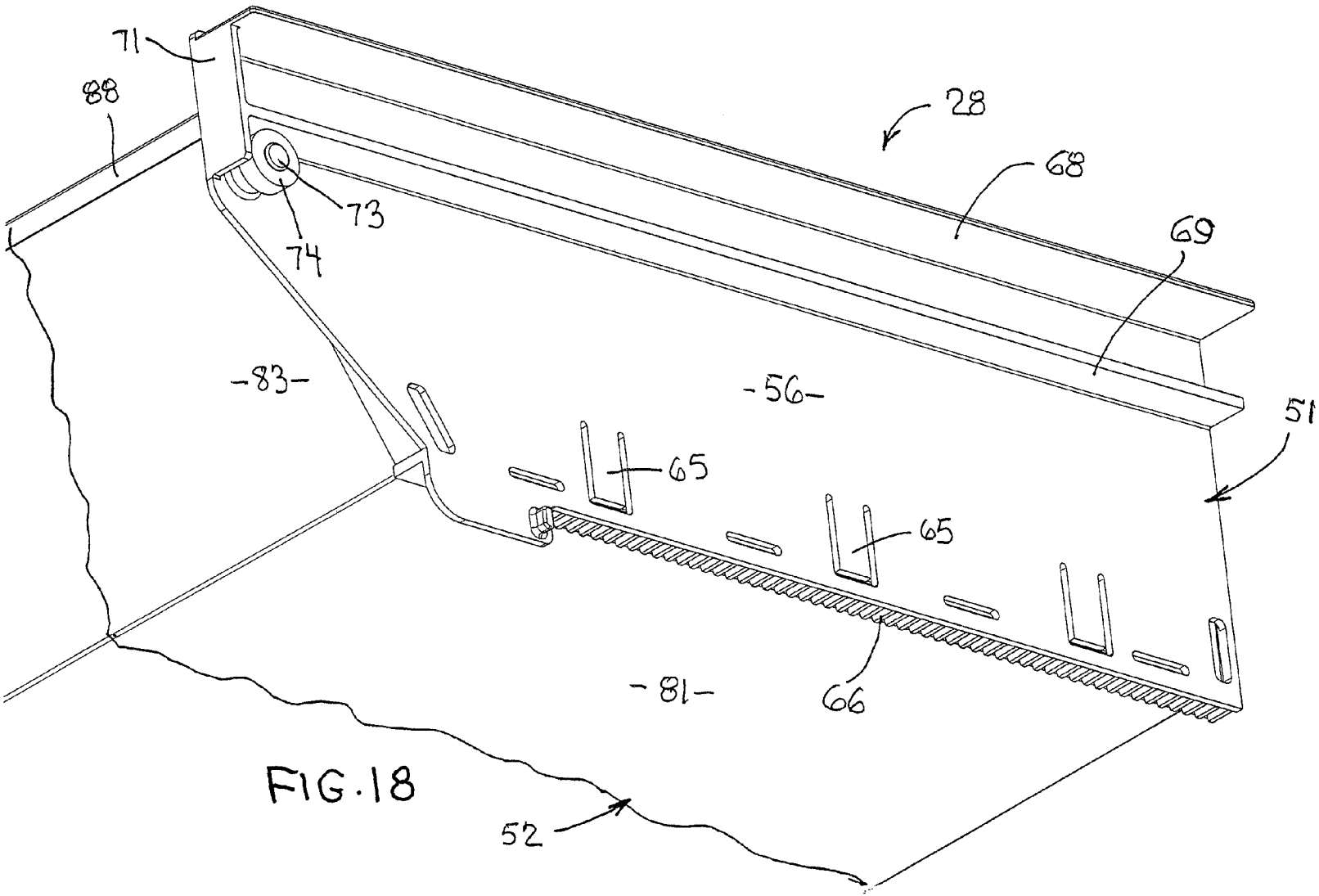
FIG. 18 is a fragmentary perspective view, taken generally from below, and illustrating one end of the assembled insert drawer arrangement shown in FIG. 16.
Figure 19:
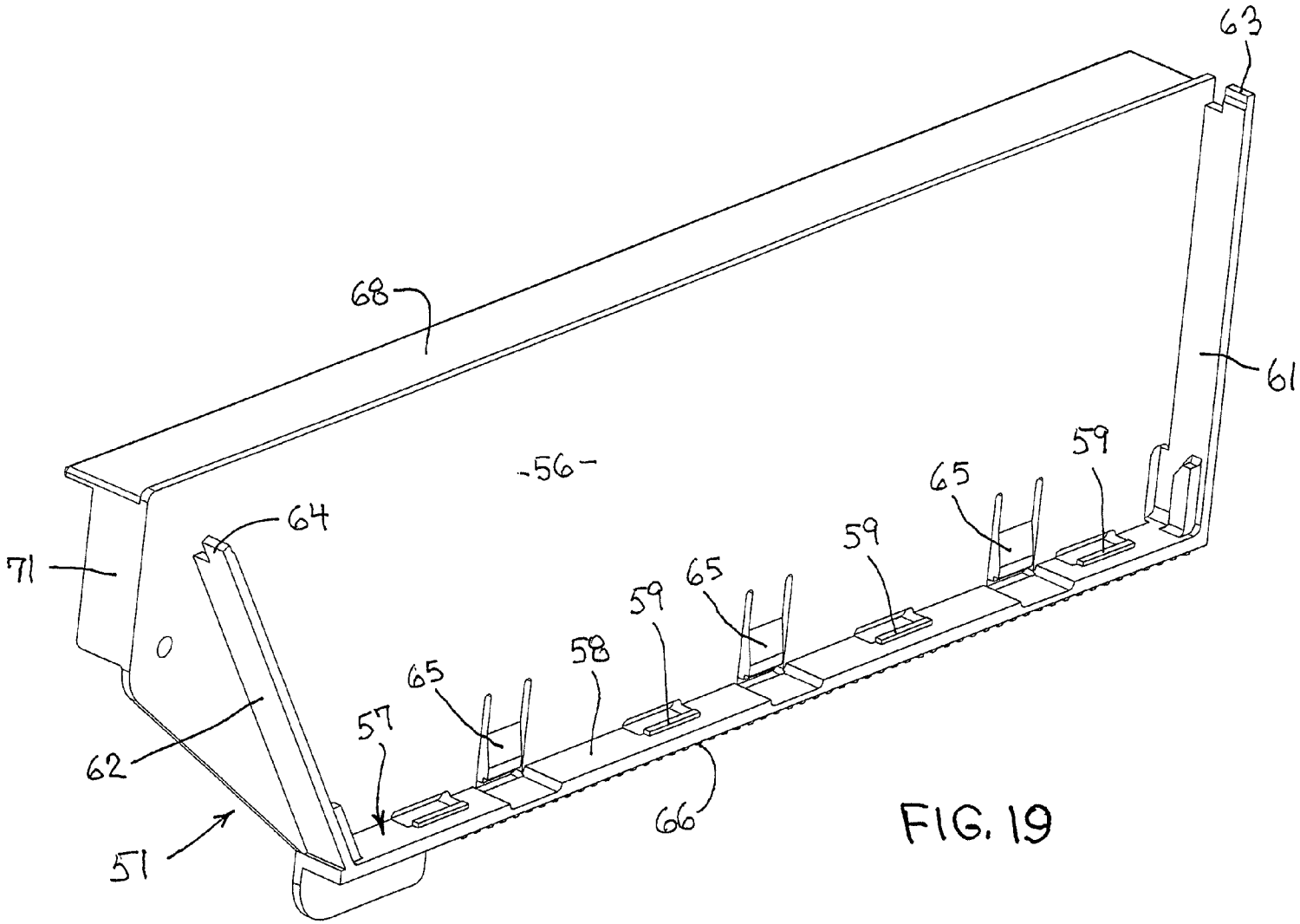
FIG. 19 is a perspective view of the end support panel which defines one end of the insert drawer, and specifically illustrating the inner side of the end support panel.
Figure 20:
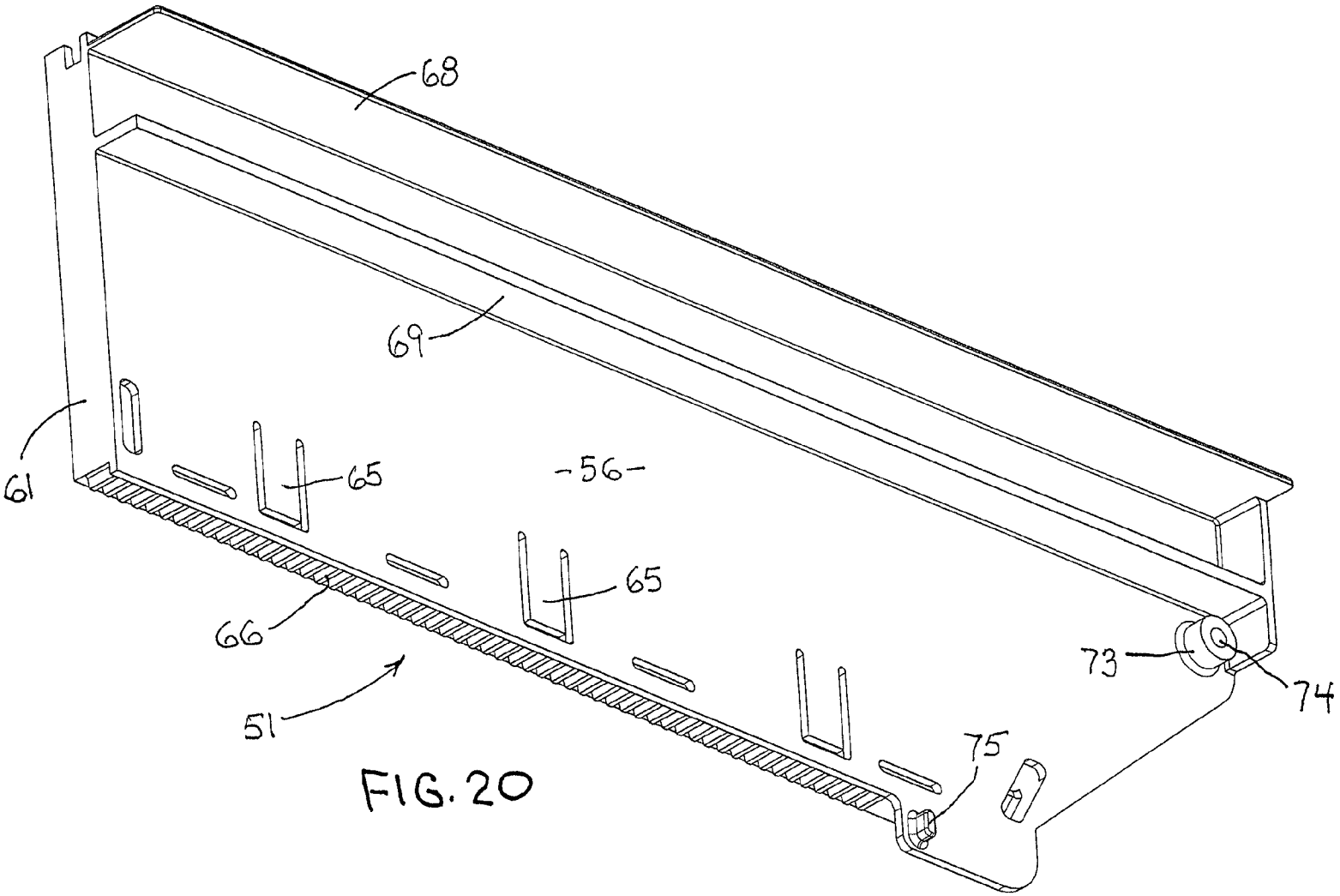
FIG. 20 is a perspective view which illustrates the opposite or outer side of the end support panel illustrated in FIG. 19.
Figure 21:
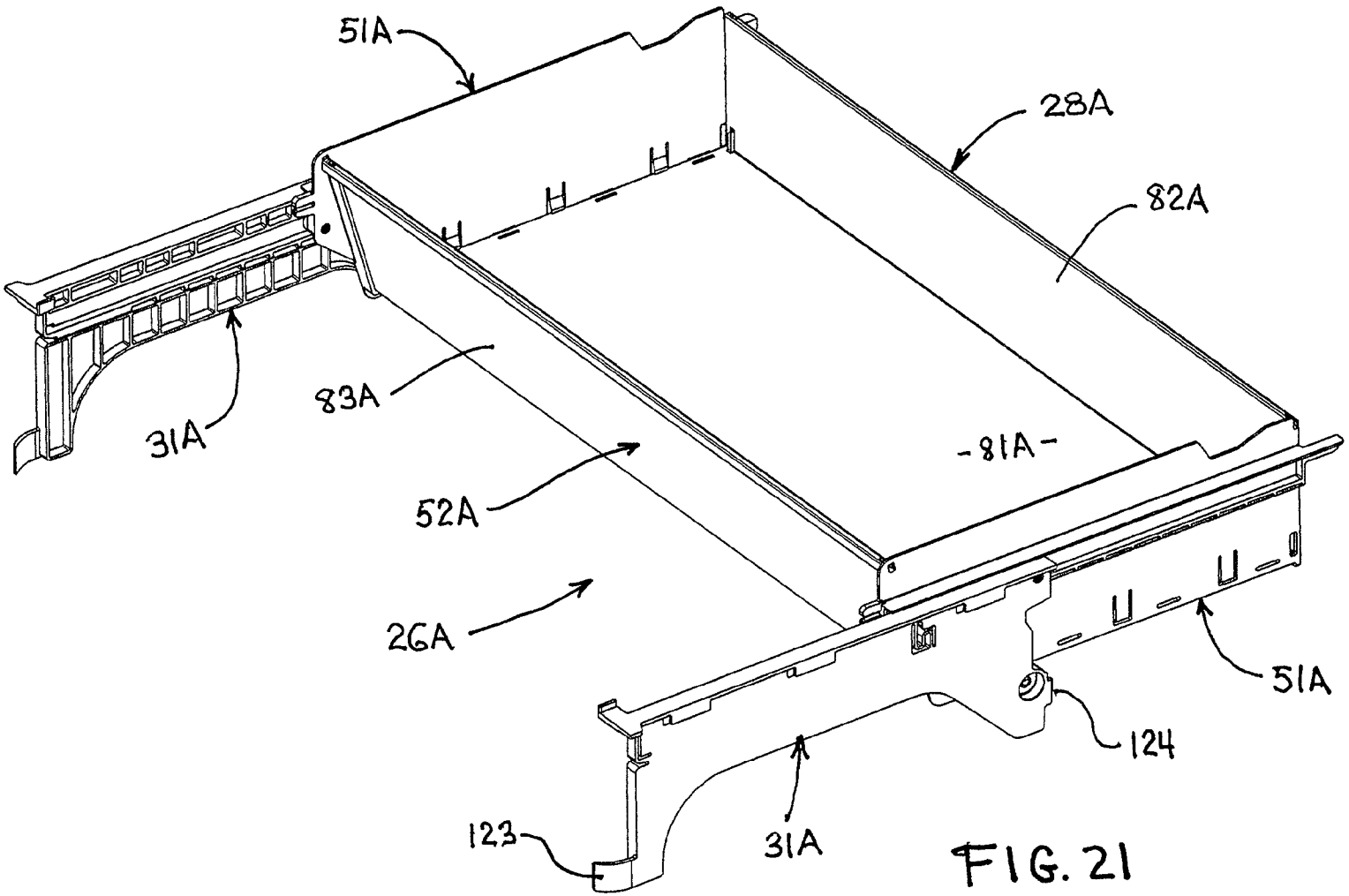
FIG. 21 is a perspective view of an insert drawer assembly in accordance with a second and preferred embodiment of the present invention, the insert drawer assembly being shown in its assembled condition and in its expanded or opened position, and shown removed from the supportive cabinet drawer box structure for clarity of illustration.
Figure 22:
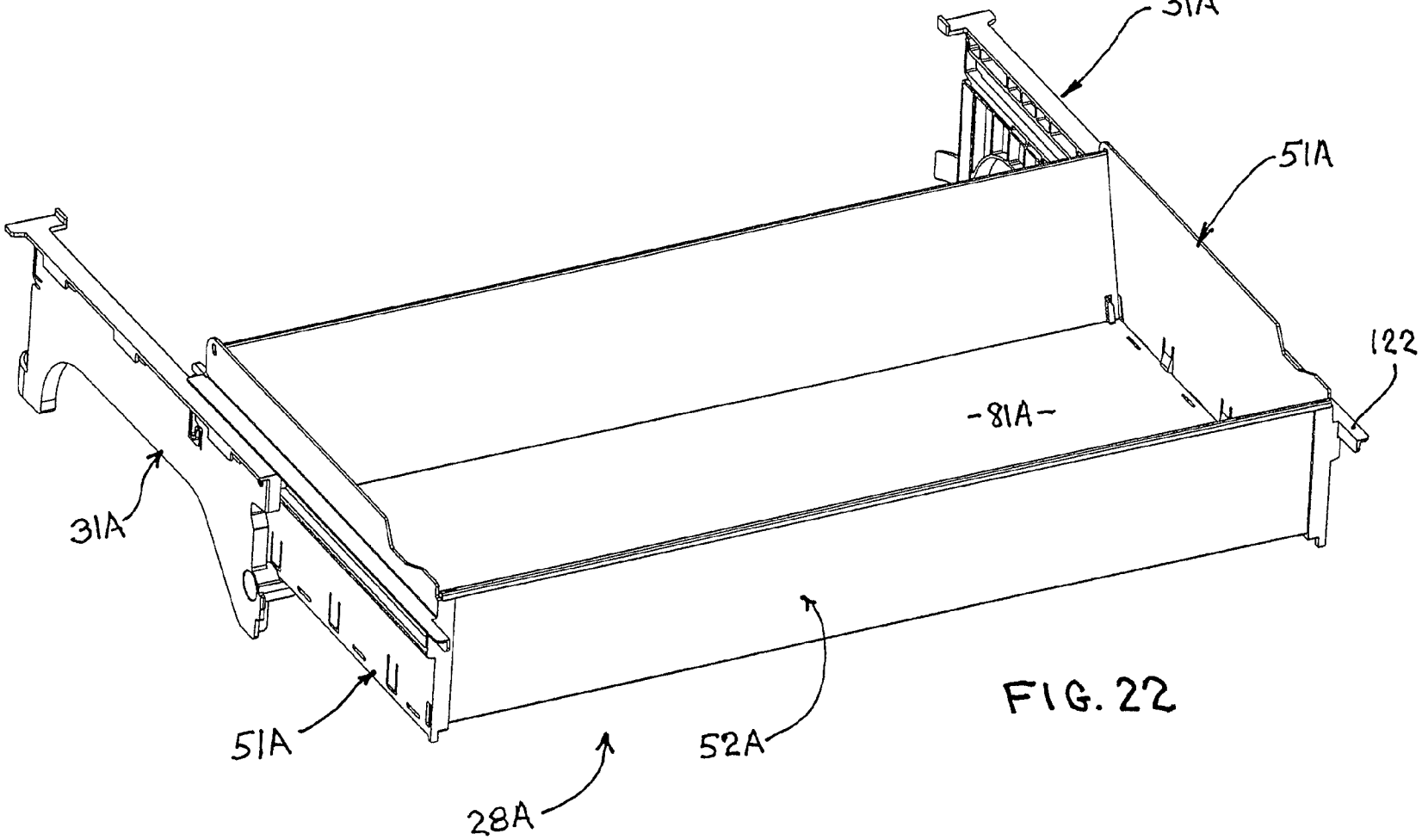
FIG. 22 is a perspective view of the insert drawer assembly of FIG. 21 shown from a different orientation.
Figure 23:
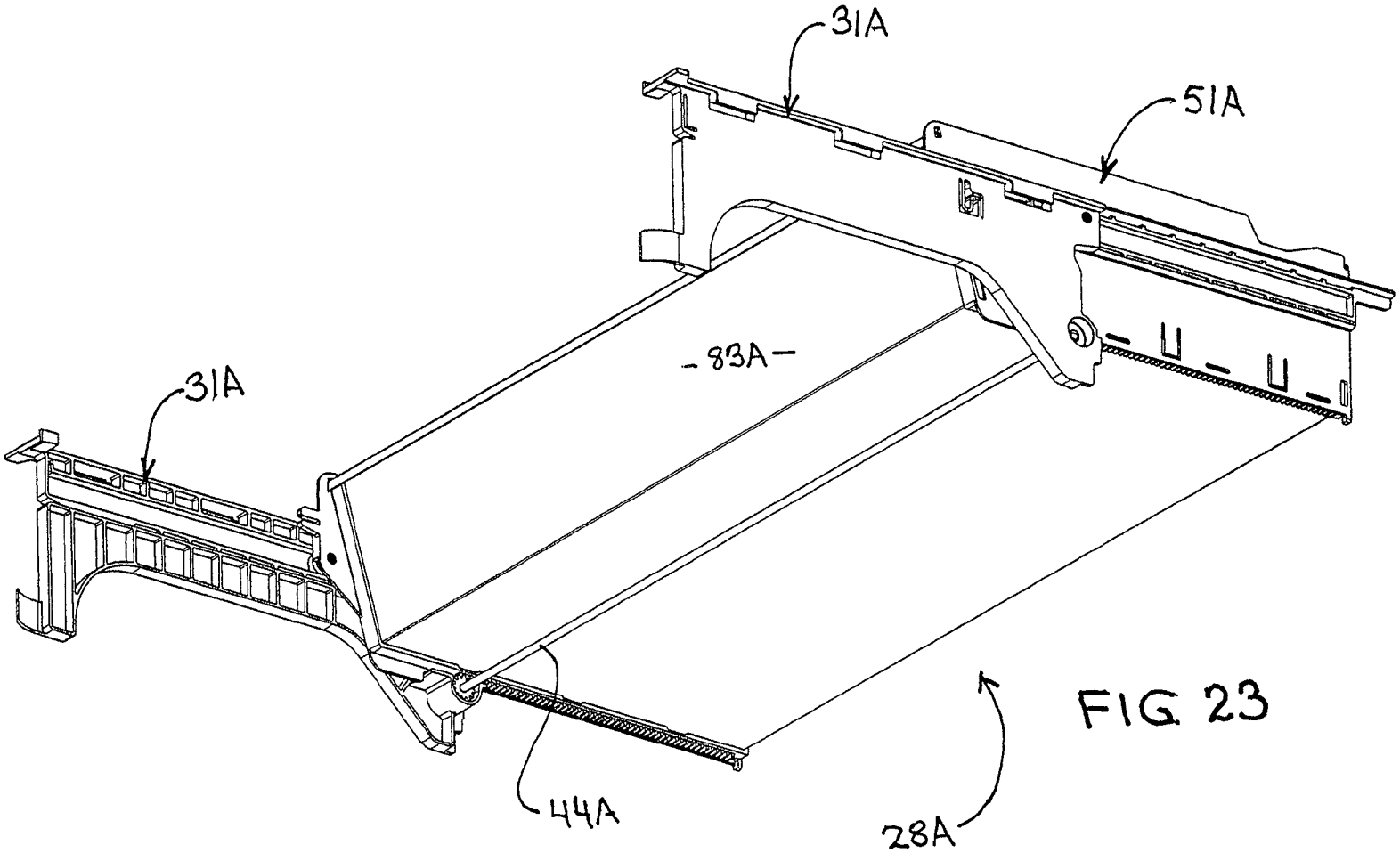
FIG. 23 is a still further view of the assembly of FIG. 21 shown from a perspective taken from below the assembly.

As illustrated in FIG. 13, the mounting panel 31 mounts front and rear pairs of guide rollers thereon directly adjacent the inner side surface of the side wall 33. Specifically, the rear pair of rollers include upper and lower guide rollers 37 and 38, respectively, which are disposed generally vertically one above the other so that the peripheries of these rollers define a narrow vertical gap therebetween, which gap is sized to permit a guide flange associated with the drawer assembly 28 (as described hereinafter) to lengthwise move therebetween. The upper and lower rollers 37 and 38 are supported for rotation about parallel horizontal axes which protrude perpendicularly relative to the side wall 33.

The other or front pair of rollers 41 and 42 are also vertically spaced and define a vertical gap between the roller peripheries, which gap corresponds to the vertical gap defined between rear rollers 37 and 38. The front rollers 41 and 42 are spaced inwardly a significant distance from the rear rollers 37-38, and as illustrated are preferably disposed in close proximity to the rear terminal end of the guide flange 36. The lower rollers 38 and 42 are disposed at an elevation whereby they are generally located close to or just above a horizontal extension of the guide flange 36. In addition, the roller 41 is preferably offset forwardly a small extent relative to the lower roller 42 to achieve maximum spacing relative to rear lower roller 38 and hence maximize the moment or torque imposed on the drawer assembly during extension thereof, as will be apparent from subsequent discussion. Each of the rollers is rotatably supported on a support hub 39 which protrudes transversely outwardly from the side wall 33.

The right and left mounting panels 31 are joined by a horizontally elongate anti-racking shaft 44 which extends perpendicularly between the mounting panels 31 at a location adjacent rear lower corners thereof. The elongate anti-racking shaft 44 has the ends thereof rotatably supported on hubs 43 which are fixed to the mounting panels 31 adjacent the lower rear corners thereof. The anti-racking shaft 44 in turn mounts adjacent opposite ends thereof, a pair of anti-racking gears 45 which are non-rotatably coupled to the shaft 44 and are disposed in close proximity to the inner side surfaces of the upright side walls 33 adjacent the lower rear corners thereof. The anti-racking gears 45 are provided for creating rolling meshing engagement with racks formed on the drawer assembly 28, as described hereinafter.

Each mounting panel 31 has a short rear leg 47 which is fixed to and cantilevered downwardly from the lower edge of the side wall 33 adjacent the rear vertical edge thereof. This rear leg 47, at its lower end, is provided with a bottom flange 49 which protrudes horizontally rearwardly and which hooks under the shoulder 19 defined in the rear wall 18 of the drawer box structure when the mounting panel 31 is mounted on the respective end wall 17.

The mounting panel 31 also has a longer front leg 46 fixedly joined to and cantilevered downwardly from the lower edge of the side wall 33 and which effectively constitutes an extension of the front edge of this latter wall. The front leg is of greater vertical extent so that the bottom or free end thereof is adopted to bear against the bottom wall 16 of the box structure when the mounting panel 31 is mounted on the respective end wall 17. The front leg 46 is also provided with a horizontally projecting tab 48 at the lower end thereof, which tab 49 projects forwardly into a slot or recess associated with the front wall 20 of the box structure to assist in positionally securing the mounting panel 31 to the respective end wall 17.

Figure 12:
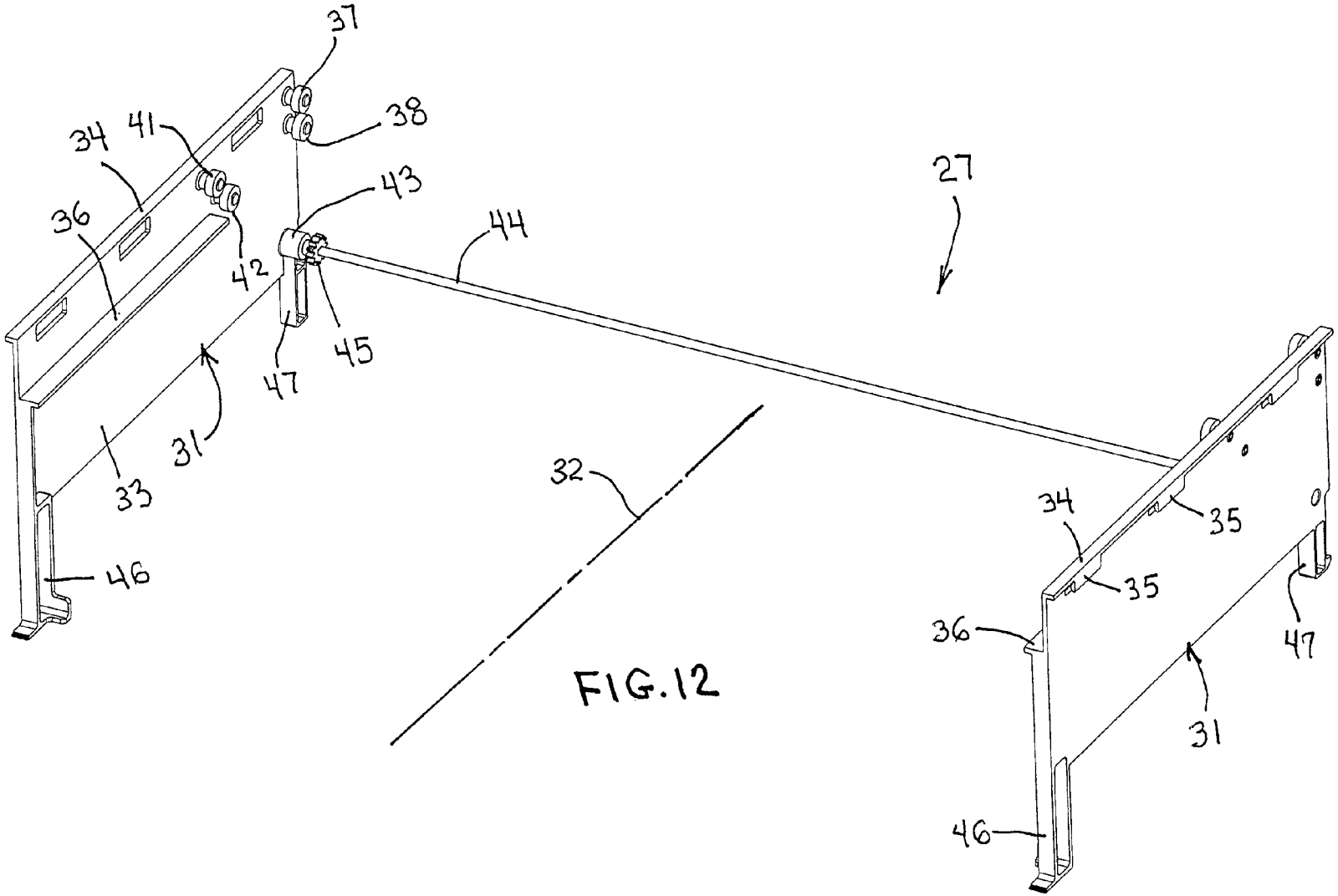
FIG. 12 is an upper perspective view of a mounting assembly which forms part of the insert drawer arrangement, which mounting assembly couples to the end walls of the original drawer box structure.

The mounting assembly 27, when assembled as illustrated in FIG. 12, supports the drawer assembly 28 so that it extends lengthwise (i.e. side-to-side) of the original box structure 15 with opposite ends of the insert drawer assembly 28 being supported on the mounting panels 31 which in turn mount on the end walls 17. The support of the drawer assembly 28 on the mounting panels 31 is defined by a horizontal support arrangement which enables the drawer assembly 28 to be horizontally movably displaced between the two positions illustrated by FIGS. 3 and 4, as discussed below.

The insert drawer assembly 28, as illustrated by FIGS. 16-19, is defined primarily by a pair of support panels 51 which supportingly engage opposite ends of a horizontally-elongate insert drawer member 52, the latter having a generally upwardly-opening channel-shaped cross section. The channel-shaped drawer member 52 and its attachment at its ends to the support panels 51 defines a generally upwardly-oriented storage compartment 53.

The support panels 51 are disposed in generally parallel and sidewardly-spaced upright relationship and effectively define right and left panels disposed as mirror images of one another on opposite sides of the central vertical plane which contains the horizontal centerline 32 (FIG. 12). The support panels 51, like the mounting panels 31, are preferably formed in one-piece of a plastics material and can be molded or formed by any suitable process. These support panels 51 are disposed directly sidewardly adjacent but inwardly of the respective right and left mounting panels 31 when the overall arrangement is assembled.

Each support panel 51 includes a main upright end wall 56 which, on the inner side surface thereof, is provided with a mounting flange arrangement 57 (FIG. 19) which projects outwardly a small distance from the respective side surface. This flange arrangement 57, in vertical profile, has an upwardly opening channel-shaped configuration which corresponds generally to the channel-shaped configuration of the drawer member 52. More specifically, this flange arrangement 57 is defined by a generally horizontally elongate bottom or base flange 58 which extends horizontally of the end wall 56 at a location adjacent a lower edge thereof. This base flange 58 has a plurality of positioning projections or ribs 59 projecting upwardly from the upper surface thereof, which ribs are individually horizontally elongated, and the plurality of ribs are generally horizontally aligned in spaced relationship along the front-to-back direction of the base flange 58.

The flange arrangement 57 also includes a rear flange 61 which joins to the rear end of base flange 58, and which projects vertically upwardly along a rear edge of the main end wall 56. The other end of base flange 58 joins to a front flange 62 which is inclined outwardly as it projects upwardly and terminates at an upper free end disposed in close proximity to a front edge of the end wall 56. The rear and front flanges 61 and 62, respectively, are provided with upwardly-protruding finger-like tabs 63 and 64, respectively, at the upper ends thereof. The end wall 56, at a location adjacent but just above the base flange 58, has a plurality of downwardly cantilevered spring tabs 65 formed therein, which tabs 65 have lower free ends thereof inclined inwardly so as to be disposed closely adjacent and directly over the bottom flange 58. In addition, the flange 58, generally throughout the horizontal front-to-back length thereof, has a downwardly-projecting gear rack 66 formed on the underside thereof. The gear rack 66 is positioned for engagement with the respective anti-racking gear 45, as discussed hereinafter.

Each support panel 51 also has a horizontally-elongate top flange 68 which is joined to the end wall 56 and extends lengthwise along the entire upper edge thereof, and which projects generally horizontally outwardly from the outer side surface of the end wall 56. A further horizontally-elongate flange 69 (FIG. 18) is also formed on and protrudes horizontally outwardly from the outer side surface of the end wall 56. This flange 69, which functions as a guide rail, is disposed downwardly a small vertical distance from the top flange 68, and extends horizontally in generally parallel relationship therewith. The flanges 68 and 69, at their forward ends, are rigidly joined by a vertical front flange 71.

Each support panel 51, adjacent a front edge thereof in close proximity to but below the forward end of the guide rail 69, is provided with an outwardly projecting support hub 73 which in turn supports thereon a front support roller 74, the latter being rotatable about a horizontal axis which is defined by the support hub and extends generally perpendicular to the vertical plane of the support panel.

A protrusion or stop 75 (FIG. 20) is formed on and protrudes outwardly from the outer side of end wall 56. This protrusion 75 is disposed adjacent a front lower corner and at an elevation closely adjacent but below that of the rack 66 and functions as a stop for the respective gear 45.

The channel-shaped drawer member 52, which extends between and is supported on the support panels 51, includes a generally horizontally planar bottom wall 81 which at its lengthwise-extending rear edge joins to a generally vertically upright rear wall 82, and at its longitudinally-extending front edge joins to an upwardly projecting front wall 83, the latter being sloped outwardly as it projects upwardly. The drawer member 52 is preferably a horizontally-elongate one-piece member.

To secure the drawer member 52 to the right and left support panels 51, the bottom wall 81 of the drawer member has a plurality of elongate narrow slots 84 formed therethrough adjacent each end edge, which slots 84 align with and receive therein the positioning ribs 59 associated with the mounting flanges 58. When the bottom wall 81 is seated on the flanges 58, the spring tabs 65 initially deflect outwardly to allow passage of the bottom wall 81 downwardly therepast, and then the spring tabs 65 spring inwardly so as to closely overlie the upper surface of the bottom wall 81 adjacent the end edges thereof, thereby securing the bottom wall 81 to the base flanges 58. In addition, the inclined front wall 83 has an upper flange or hem 88 extending along the upper edge thereof and, adjacent each end edge of the drawer member, the flange 88 has an opening 89 which accommodates therein the fingerlike projection 64 associated with the upper end of the inclined front flange 62 to effect securement with the front wall. Similarly, the rear wall 82 has an upper flange or hem 86 which has an opening 87 therethrough adjacent each end edge, and this opening accommodates therein the upwardly-projecting securing tab or finger 63 which projects upwardly from the upper end of the rear flange 61.

When the drawer member 52 is positioned and secured to the support panels 51 as described above, the drawer assembly 28 is structurally and functionally assembled so as to define a generally rigid structure which in turn defines the upwardly-opening storage compartment 53.

The assembly of the insert drawer arrangement 26, and its mounting on the existing drawer box structure 15, will now be briefly described.

To carry out this assembly and mounting, the insert drawer arrangement 28 is initially fully assembled, and is thereafter mounted on the end walls 17 of the original drawer box structure.

In this respect, the drawer assembly 28 is initially assembled by positioning and securing the drawer member 52 to the pair of support panels 51 as briefly discussed above. The anti-racking gears 45 are mounted on opposite ends of the anti-racking shaft 44. In this respect, the gears and the shaft ends are provided with flats thereon so that, when the gears are slidably moved onto the ends of the shaft and up against flats for positioning purposes, the gears are non-rotatably coupled to the shaft 44. This gear-shaft subassembly is then positioned so as to engage each gear 45 with the rearward end of the respective rack 66. For this purpose, the drawer assembly 28 is preferably disposed in an inverted position so that the racks 66 face upwardly, thereby enabling the gears 45 to be positioned in meshed relationship with the racks 66 adjacent the rearward ends thereof. The mounting panels 31 are then moved inwardly toward the outer sides of the respective end panels 51. One of the mounting panels 31 is initially moved inwardly to slidably engage the end of the shaft 44 in the respective hub, while simultaneously causing the guide rail 69 to be slidably inserted into the gap defined between the front and rear pairs of rollers 37-38 and 41-42. This also causes the front roller 73 to be positioned directly over the flange or rail 36. In similar fashion the other mounting panel 31 is moved inwardly and similarly engaged with the outer side of the other support panel 51 and the adjacent end of the anti-racking shaft. The entire assembled arrangement is then maintained in this condition by gripping and applying pressure against the outer mounting panels 31 so as to maintain the arrangement assembled, and then manually inverting the arrangement and positioning it over the upwardly-opening drawer box structure 15. The insert assembly is then slowly lowered downwardly, with the rear side thereof inclined slightly downwardly, so that the mounting panels 31 slide snuggly downwardly adjacent the inner surfaces of the end walls 17, which downward movement is continued until the upper edges of the end walls 17 seat within the channels defined by the tabs 65 located adjacent the top flanges of the mounting panels 31. This downward movement enables the hooks 49 on the rear legs 47 to pass below and move into engagement below the shoulder 19 formed on the rear wall 18 of the box structure. Continued downward movement of the front side of the drawer insert assembly is possible due to resilient deflection of the long front legs 46 which, upon reaching the drawer bottom wall 16, deflect forwardly to engage the front hooks 48.

With the insert arrangement assembled to the box structure as described above, the insert drawer 52 is disposed directly over but in upwardly spaced relationship relative to the bottom wall 16, thereby defining two storage compartments disposed vertically one above the other, namely an upper compartment 53 defined by the insert drawer, and a lower compartment 20 as defined by the original drawer. These two compartments will typically be of similar depths so as to maximize the usability thereof, although this obviously can be varied to suit specific needs by varying the depth of the insert drawer 52.

When assembled, access to the storage compartments occurs by normal outward opening of the cabinet drawer into the extended position illustrated by FIG. 3, in which position the upper storage compartment 53 is readily accessible. If access to the lower storage compartment 20 is also desired, then the user can readily manually engage the front wall of the insert drawer member 52 and slidably displace this drawer member 52 backwardly into the cantilevered extended position illustrated by FIG. 4, which later position results in the insert drawer 52 projecting a substantial extent into the interior of the cabinet housing. However, this rearward disposition of the insert drawer is such that at least limited access to the upper storage compartment 53 is still permissible adjacent the front wall thereof. At the same time, however, the lower storage compartment 20 is also readily accessible.

While the insert drawer assembly of this invention can be assembled to the existing drawer of a file cabinet at the site of manufacture if desired, it is nevertheless contemplated that the drawer insert arrangement will preferably be packaged as a kit so as to facilitate transport and subsequent assembly of the drawer insert arrangement to an existing file drawer at a position of use. Such kit will obviously include the components illustrated and described above.

While the above description and related FIGS. 2-20 describe a first embodiment of an insert drawer assembly according to the present invention, the following description and related FIGS. 21-36 describe a second embodiment of an insert drawer assembly according to the present invention. This second embodiment (FIGS. 21-36) incorporates many of the same structural and functional relationships possessed by the first embodiment as hereinbefore described. Accordingly, for simplification of description and reference, the parts and components of the second embodiment (FIGS. 21-36) which have corresponding parts in the first embodiment (FIGS. 2-20) are identified using the same reference numerals utilized in the identification of the first embodiment but with addition of an "A" thereto.

This embodiment of a drawer insert arrangement 26A, as illustrated by FIGS. 21-23, again include a pair of mounting panels 31A which are effectively mirror images of one another and function as right and left panels which mount to the respective right and left end walls 17 of the existing drawer box structure 15. These mounting panels 31A support thereon an insert drawer assembly 28A so that the latter is horizontally movable relative to the mounting 31A between contracted and extended positions, the extended position being illustrated by FIGS. 21-23. This insert drawer assembly 28, like the previously described first embodiment, includes a drawer defined principally by the insert drawer member 52A which is closed at opposite ends by right and left support panels 51A, which latter panels are effectively mirror images of one another and define right and left panels which are disposed adjacent and horizontally movably supported on the respective right and left mounting panels 31A.

Figure 24:
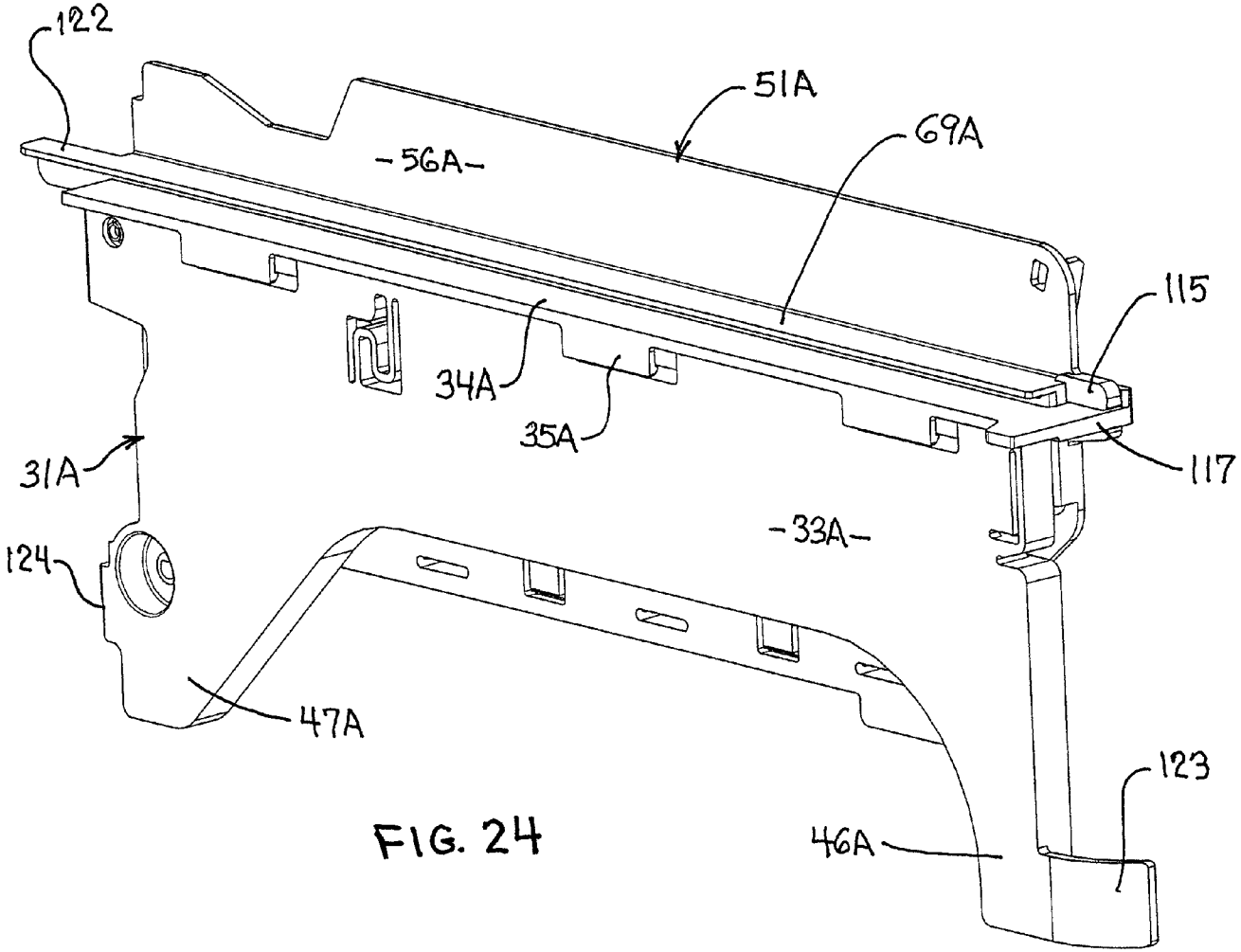
FIG. 24 is a perspective view of the assembled mounting and support panels of the assembly of FIG. 21, which panels are shown in their contracted positions and are viewed dominantly from the outer side of the mounting panel.
Figure 25:
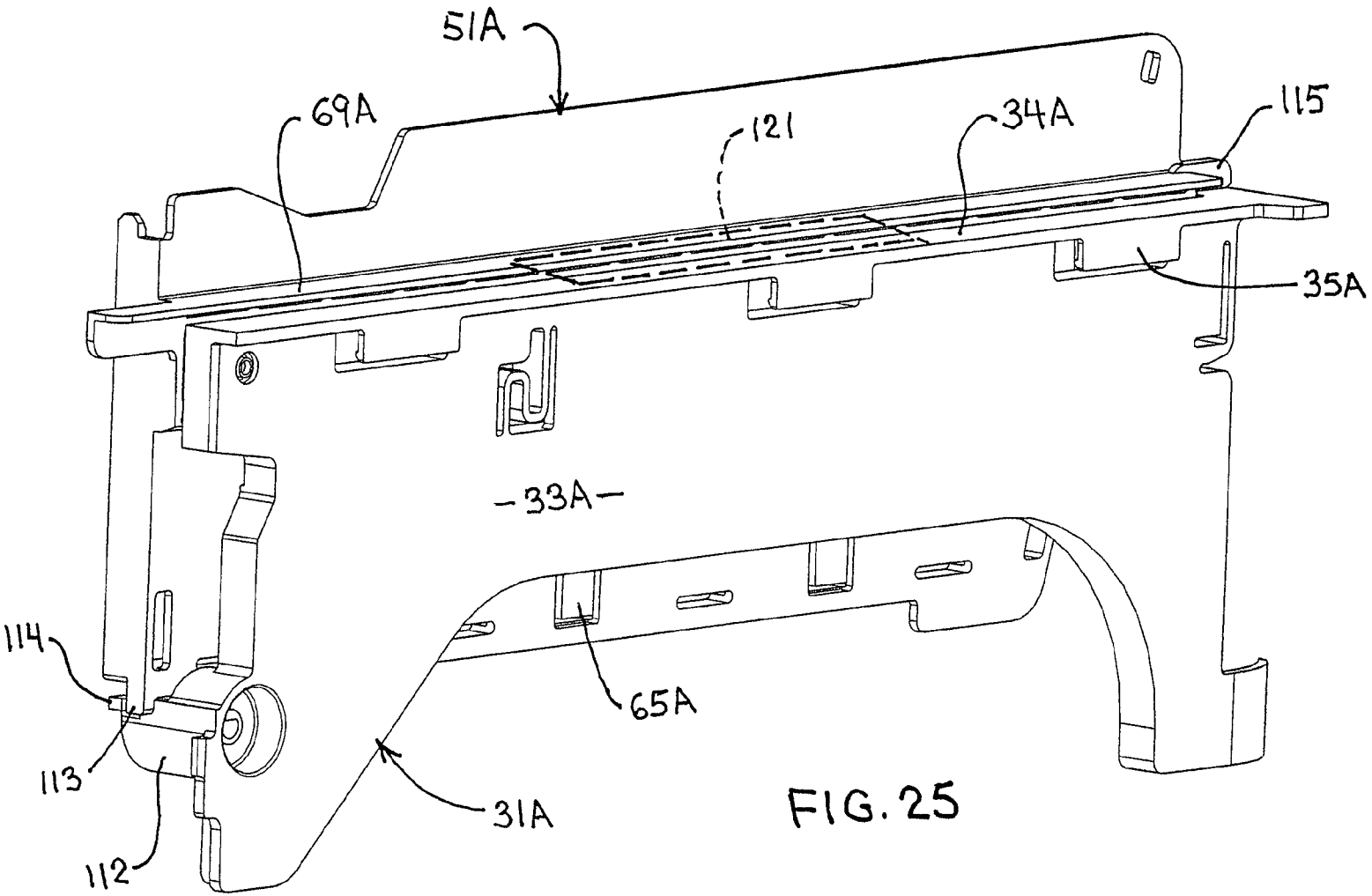
FIG. 25 is a perspective view similar to FIG. 24 but taken from a slightly different orientation.
Figure 26:
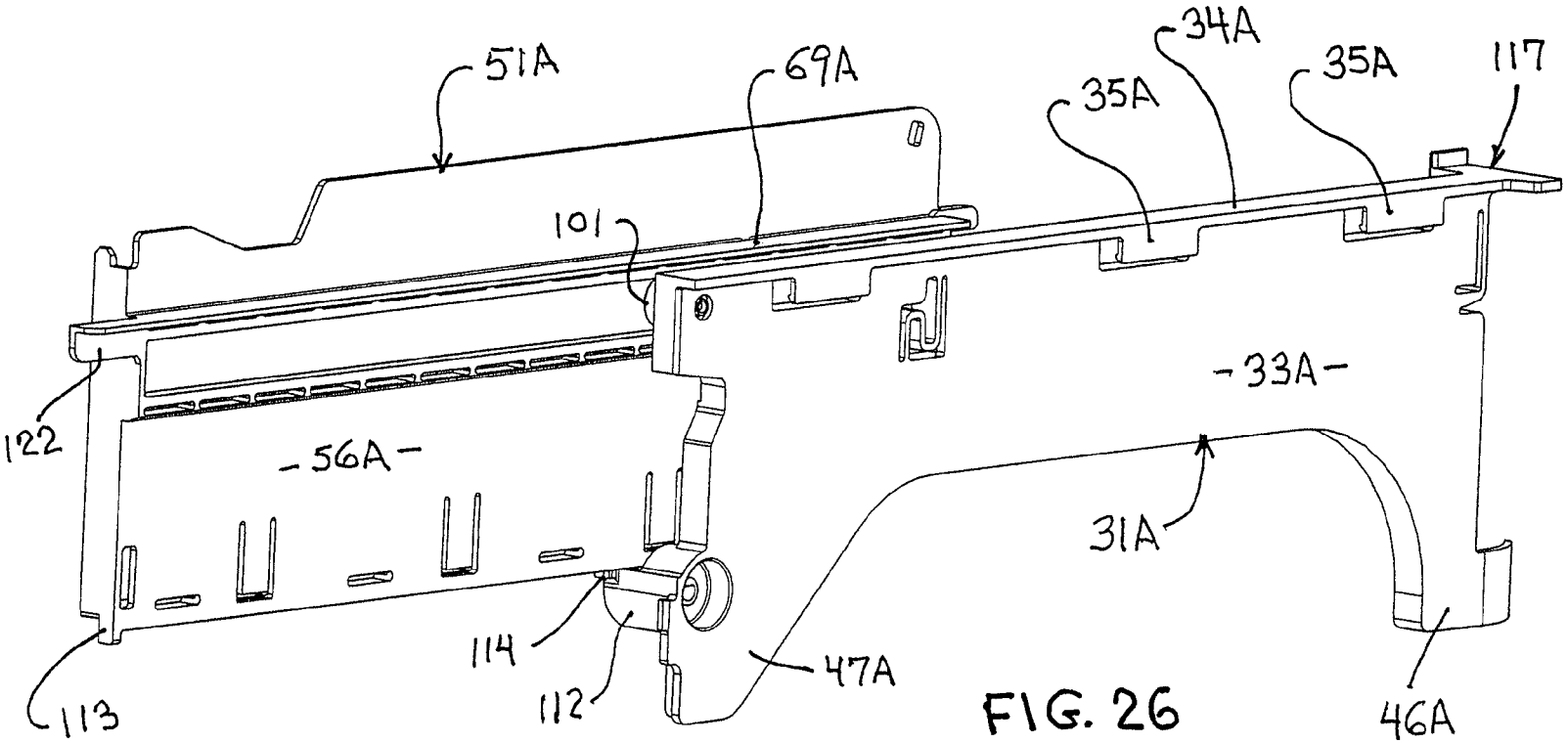
FIG. 26 is a perspective view corresponding generally to FIG. 24 but showing the assembled mounting and support panels in their extended or open position.

The mounting panel 31A, as illustrated by FIGS. 24-26, is defined primarily by an upright side wall 33A which has a horizontally-elongate flange 34A extending lengthwise along the upper edge thereof, which flange 34A projects outwardly and adjacent the outer edge is provided with a plurality of downwardly cantilevered securing tab 35A. The tab 35A and top flange 34A cooperate with side wall 33A to define a channel structure which enables the mounting panel 31A to be snap fitted and secured over the upper edge of the box structure end wall 17 to hence position the side wall 33A directly adjacent the inner upright side surface thereof, in the same manner as described above relative to the first embodiment.

The support panel 51A, which is positioned directly adjacent the inner side of the respective mounting panel 31A and is horizontally movably supported thereon, has a construction associated with the inner side surface thereof generally similar to that associated with the first embodiment, as described above. Briefly, as illustrated by FIGS. 27-30, the support panel 51A is defined primarily by an upright side wall 56A which, on the inner side surface, has an upwardly-opening channel-shaped flange structure 57A which includes the horizontal bottom flange 58A which at opposite ends joins to the upright rear and front flanges 61A and 62A, respectively. This flange structure seats the end of the insert drawer member 52A therein, and for this purpose the bottom flange 58A has upwardly projecting ribs 59A which cooperate with slot-like recesses formed in the bottom wall of the drawer member 52A, and the spring tabs 65A spring inwardly and overlap the bottom wall of the insert drawer member when the latter is seated on the channel-shaped flange structure 57A. The bottom flange 58A is also provided with gear rack 66A formed on the underside thereof and extending lengthwise over a significant majority of the length thereof.

The support panel 51A, on the outer side surface thereof (FIG. 31) is provided with a horizontally elongate flange 69A which extends lengthwise throughout the front-to-back length of the side wall 56A, and which projects horizontally outwardly therefrom so as to terminate at a free edge. This flange 69A is at an elevation such that, when the respective mounting panel 31A and support panel 51A are disposed in closely adjacent side-by-side relationship, the flange 69A is disposed at an elevation closely adjacent but slightly above the elevation of the top flange 34A associated with the respective mounting panel 31A, substantially as illustrated in FIGS. 24-25.

Figure 31:
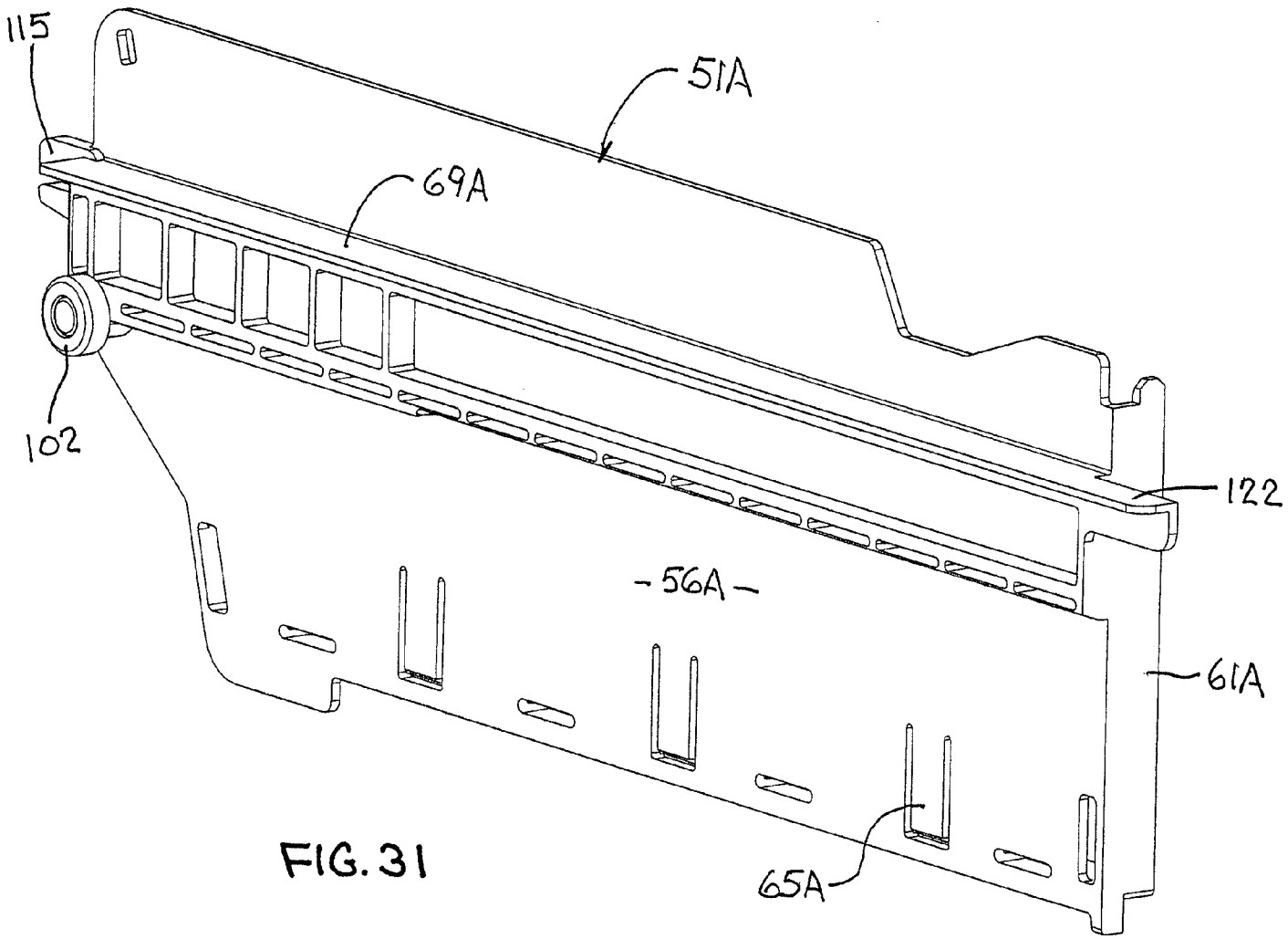
FIG. 31 is a perspective view of solely the inner support panel as shown in FIG. 29, but showing the outer side thereof.
Figure 32:
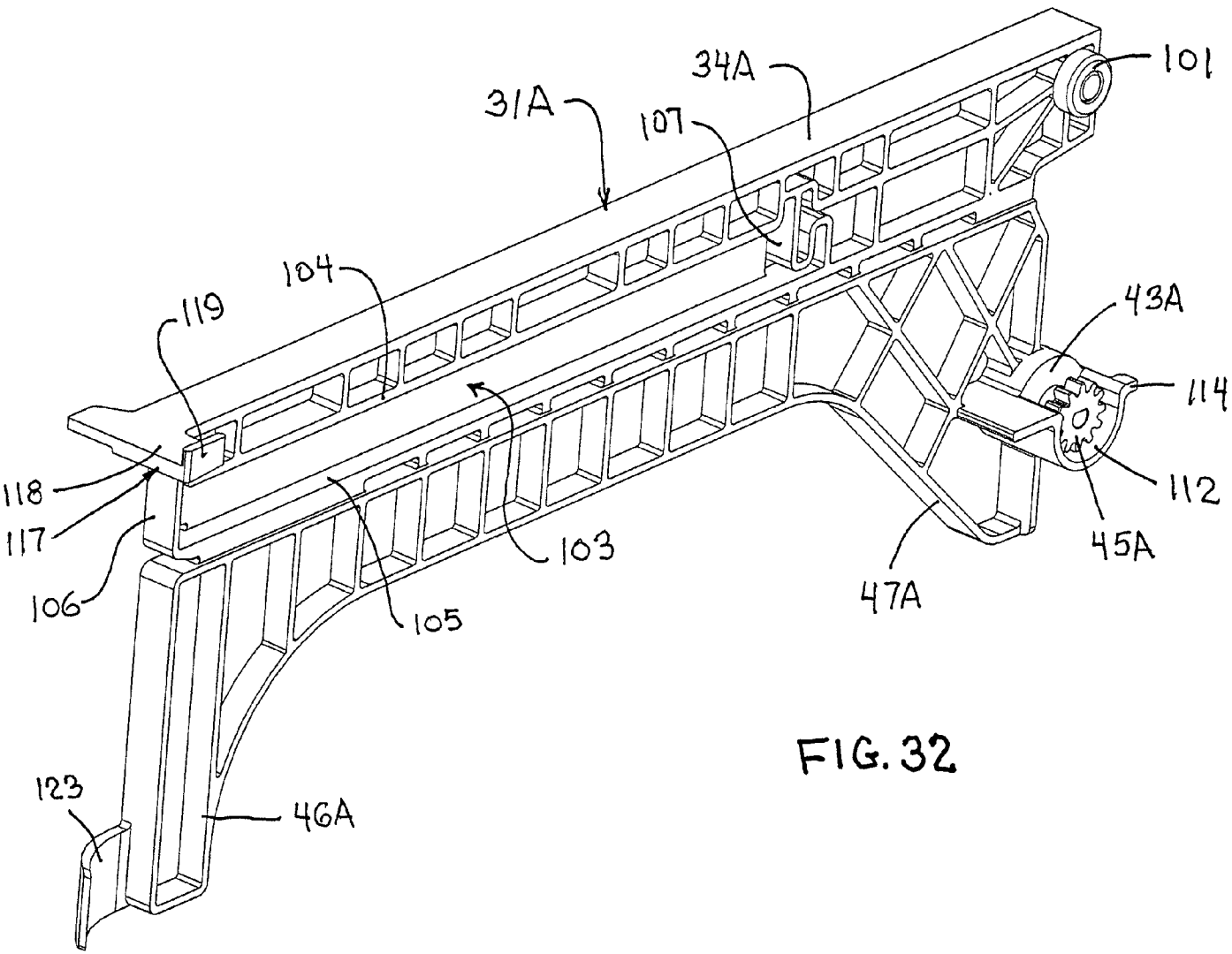
FIG. 32 is a perspective view of solely the outer mounting panel, and showing primarily the inner side thereof.
Figure 33:
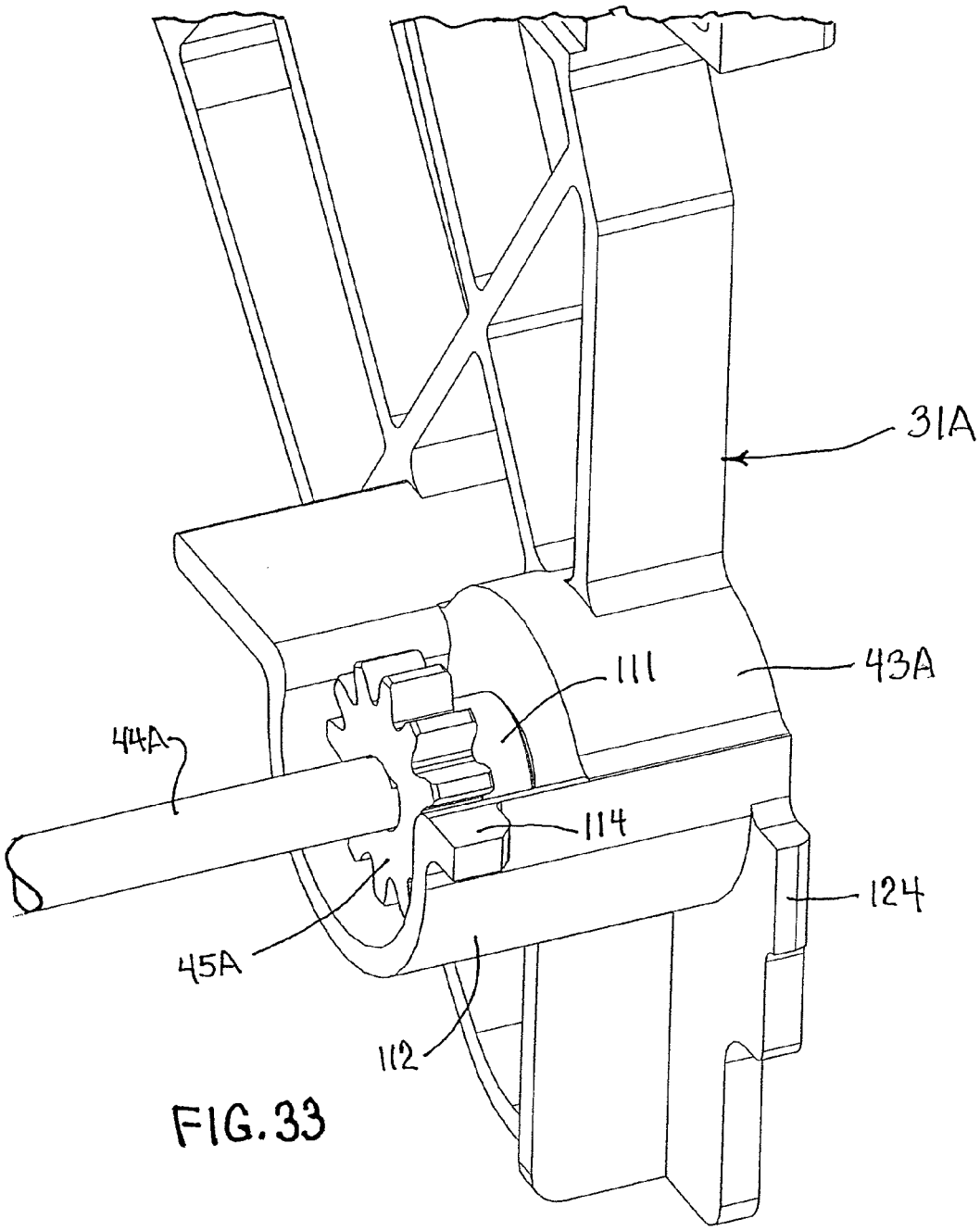
FIG. 33 is a fragmentary perspective view which illustrates the mounting structure and shield associated with the lower rear corner of the mounting panel, and its cooperation with one end of the anti-racking shaft and its respective gear.

To horizontally movably support the support panel 51A on the respectively adjacent mounting panel 31A, the mounting panel 31A has, as illustrated in FIG. 32, a single roller 101 rotatably supported thereon adjacent the rear upper corner thereof. This roller 101 is disposed adjacent but slightly below the top flange 34A in close proximity to the rearward edge of the mounting panel 31A, and is positioned so that it is disposed adjacent the inner side surface of the mounting panel. Roller 101, when the panels 31A and 51A are disposed and sidewardly adjacent assembled relationship, is disposed for rolling engagement with the bottom surface of the guide rail 69A formed on the adjacent support panel 51A, as illustrated by FIG. 26. A further roller 102 (FIG. 31) is mounted on the adjacent support panel 51A adjacent the front edge thereof. This roller 102 is disposed adjacent the outer side surface of the side wall 56A, and is disposed at an elevation whereby it is spaced downwardly a distance below the guide rail 69A. The roller 102, like the roller 101, is supported for rotation about a generally horizontal axis which extends perpendicular to the main side wall of the respective panel. The roller 102 as mounted on the support panel 51A is disposed for rolling cooperation with an elongated guide track 103 formed on the opposed inner surface of the respective mounting panel 31A. This guide track 103, as illustrated by FIG. 32, is defined by generally parallel and horizontally elongate top and bottom flanges 104 and 105 which are vertically spaced by a distance which equals but preferably slightly exceeds the outer diameter of the roller 102 so as to readily accommodate but confine the roller therebetween. The track or space defining the flanges 104 and 105 is horizontally elongated from a location adjacent the front edge of the mounting panel 31A to a location which is spaced forwardly from the rear thereof. This length of the track 103 enables the roller 102 to move lengthwise therealong when the insert drawer assembly 52A is moved between its contracted and extended positions. The track 103, at the ends thereof, is closed by a front stop 106 and a rear stop 107, both of which are constructed so as to have limited softness when the roller 102 is moved into contact therewith.

Figure 34:
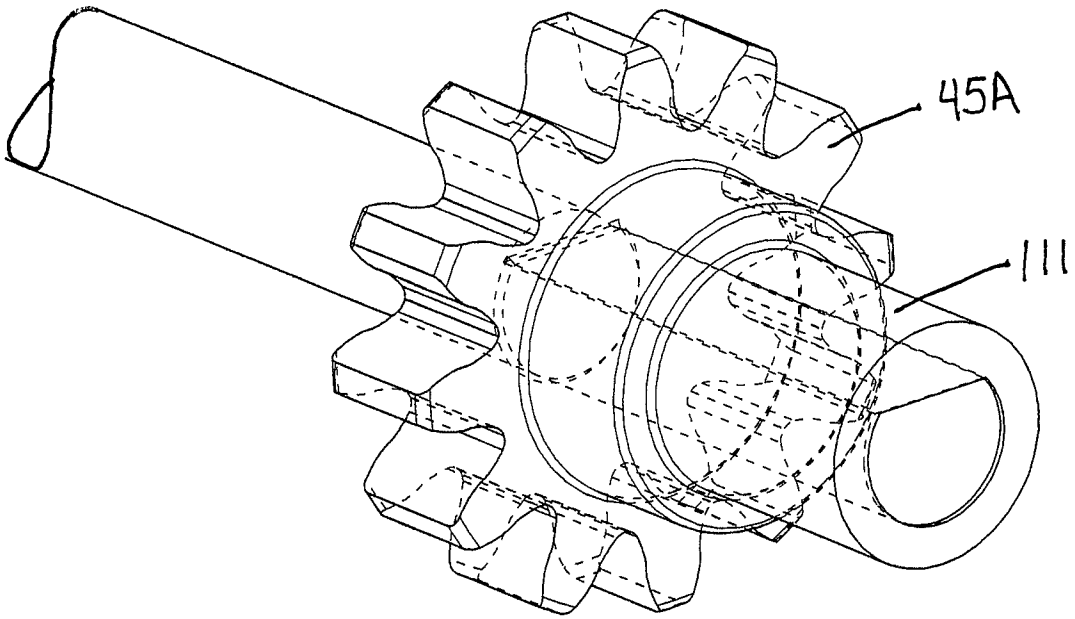
FIG. 34 is a fragmentary perspective view showing one end of the anti-racking shaft and the gear mounted thereon.

To prevent skewing of the insert drawer assembly 28 during the horizontal movement thereof toward or away from the extended position, the anti-racking gears 45A, and their non-rotatable connection through the shaft 44A, are deposed for meshing engagement with the gear racks 66A, with the gears 45A and their support shaft 44A being rotatably supported on the parallel mounting panels 31A adjacent the lower rear corners thereof so that the shaft 44A is positioned at an elevation slightly below the insert drawer 52A. In this embodiment, the gears 45A are non-rotatably secured to the shaft 44A by being seated on a flat against a shoulder, as illustrated in FIG. 34, and the gears are secured into position by a cylindrical sleeve or bushing 111 which is non-rotatably secured to the outer end of the shaft 44A adjacent the respective gear 45A. The bushing 111 in the illustrated embodiment is of a stepped configuration having larger and smaller cylindrical parts. The smaller-diameter outer cylindrical part of bushing 111 is rotatably seated within the cylindrical support hub 43A which is defined in the mounting panel 31A adjacent the lower rear corner thereof. When the bushing is seated in the support hub on the mounting panel 31A, the larger-diameter part of bushing 111 functions as a spacer which abuts the exposed end of the support hub and hence positionally orients the gear 45A so as to be disposed for meshing engagement with the respective gear rack 66A positioned directly thereabove when the panels 31A and 51A are disposed in adjacent assembled relationship.

The support hub 43A associated with the mounting panel 31A is also preferably provided with a generally semi-cylindrical sleeve-like sheath or shield projecting or cantilevered co-axially outwardly therefrom, which sheath extends around approximately the lower half of the respective gear 45 so as to provide protection for same.

Figure 27:
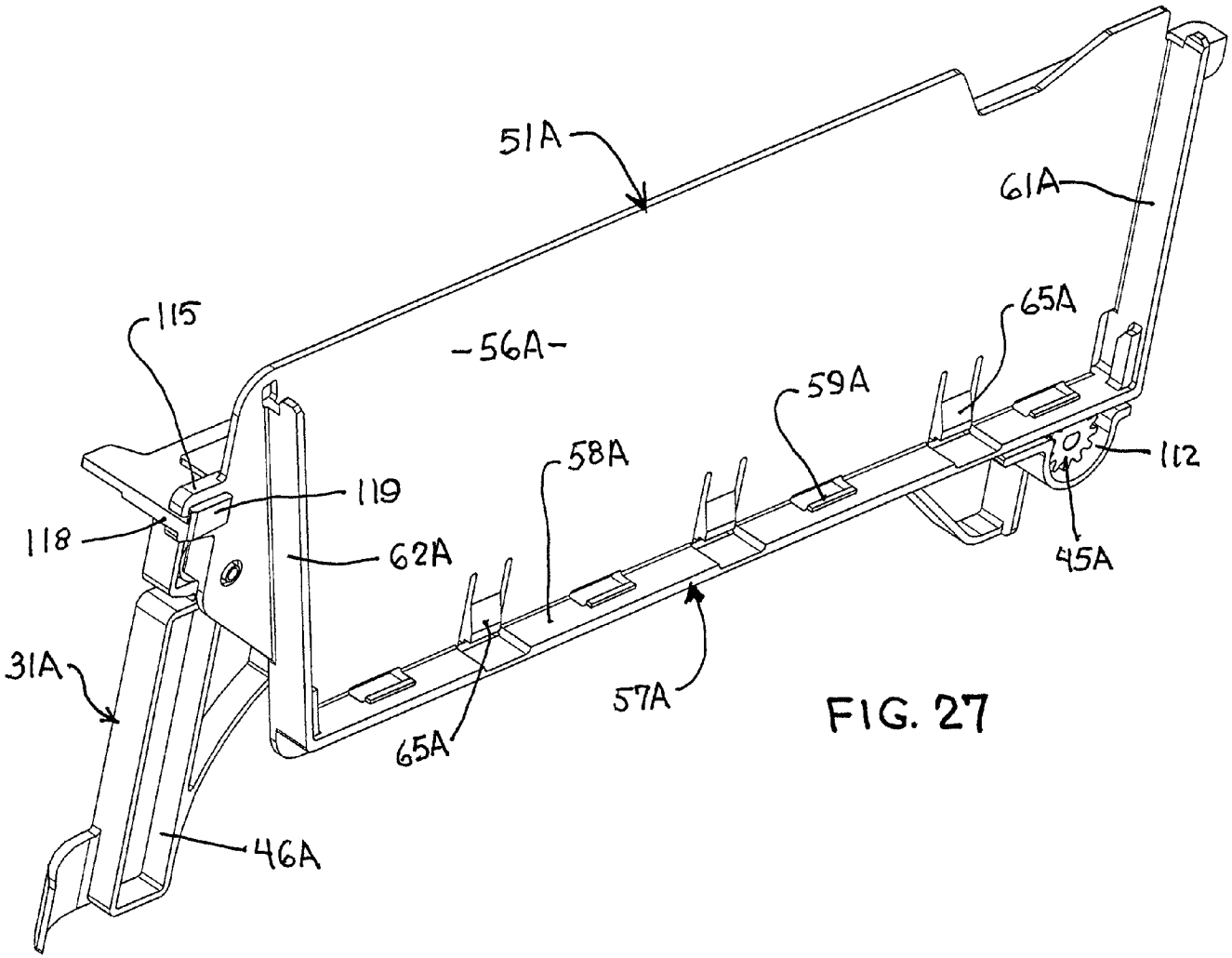
FIG. 27 is a perspective view of the assembled mounting and support panels in their contracted or closed position, and positioned to show the inner side of the support panel.

To facilitate the shipping of this embodiment in a kit form, and the subsequent assembly thereof, the adjacent mounting and support panels 31A and 51A are preferably positionally assembled together in their closed compacted position, substantially as illustrated in FIGS. 24, 25 and 27, prior to being packaged as part of a kit.

To assist in maintaining the panels 31A and 51A in adjacent assembled relationship wherein they are disposed in sideward engagement, a first sideward tab arrangement is provided adjacent the rearward edges of the panels, which tab arrangement includes a first rear tab 113 which protrudes downwardly from the lower rear corner of the side wall 56A. The tab 113 effectively constitutes an extension of the rear flange 61A. This rear tab 113 on support panel 51A cooperates with an adjacent rear tab 114 which is integrally joined to and cantilevered rearwardly from the shield or sheath 112. The tabs 113 and 114 are positioned sidewardly in overlapping relationship when the support panel 51A is in its forwardmost overlapping position with the mounting panel 31A, whereby the overlapping tabs 113-114 prevent sideward separation between the panels 31A and 51A adjacent the rearward edges thereof.

A similar sideward tab arrangement is also provided adjacent the forward edges of the panels 31A and 51A to prevent separation between the panels. This forward tab arrangement includes a front tab 115 which is effectively coplanar with the side wall 56A and is cantilevered outwardly from the front edge thereof at an elevation adjacent the horizontal flange or rail 69A. This front tab 115 has a slot which opens horizontally inwardly from the free end thereof and terminates approximately at the front edge of the side wall 56A. This front tab 115 on the support panel 51A is positioned for cooperation with a further front tab 117 which is provided on the front edge of the respective mounting panel 31A. The tab 117 is cantilevered generally horizontally outwardly from the front edge of the side wall 33A and has a L-shaped configuration defined by a generally plate-like horizontal tab part 118 which is effectively coplanar with a front end of the rail 34A but which protrudes sidewardly so as to overlap the front edge of the adjacent support panel 51A. The horizontal tab part 118 at its free edge terminates in a vertical tab part 119 which is cantilevered upwardly. This configuration of the front tab 117 enables the horizontal tab part 118 to project into the slot 116 when the support panel 51A is in its forwardmost overlapped position relative to the mounting panel 31A, and results in the vertical tab part 119 sidewardly overlapping the front tab 115 on the support panel 51A, thereby preventing sideward separation between the panels 31A and 51A adjacent the forward edges thereof.

To further assist in holding the assembled panels 31A and 51A in their overlapping positions wherein the overlapping tabs prevent sideward separation, which corresponds to the forwardmost position of the support panel 51A, a removable securing member 121, such as a strip of adhesive tape, is preferably secured along a length of the flange 34A of the mounting panel 31A. This securing strip is positioned so as to also adhesively engage the top surface of the adjacent flange 69A on the support panel 51A. This securing strip, together with the sideward tab arrangements adjacent the front and rear edges, hence retain the cooperating adjacent panels 31A and 51A in proper positional relationship, and hence greatly facilitates the subsequent aligned engagement of the anti-racking gears 45A with the respective gear racks 66A when the overall insert arrangement is assembled.

In addition to its functioning as a sideward retaining tab arrangement, the front tab 115 and specifically the slot 116 formed therein, and its cooperation with the horizontal tab part 118, also functions as a frictional engagement between the panels 31A and 51A so that the assembled insert arrangement, when mounted to an existing cabinet drawer, will insure that the support panels 51A and the associated insert drawer 52A move with the mounting panels 31A when the drawer is opened so as to provide immediate access to the storage compartment defined by the insert drawer.

Figure 28:
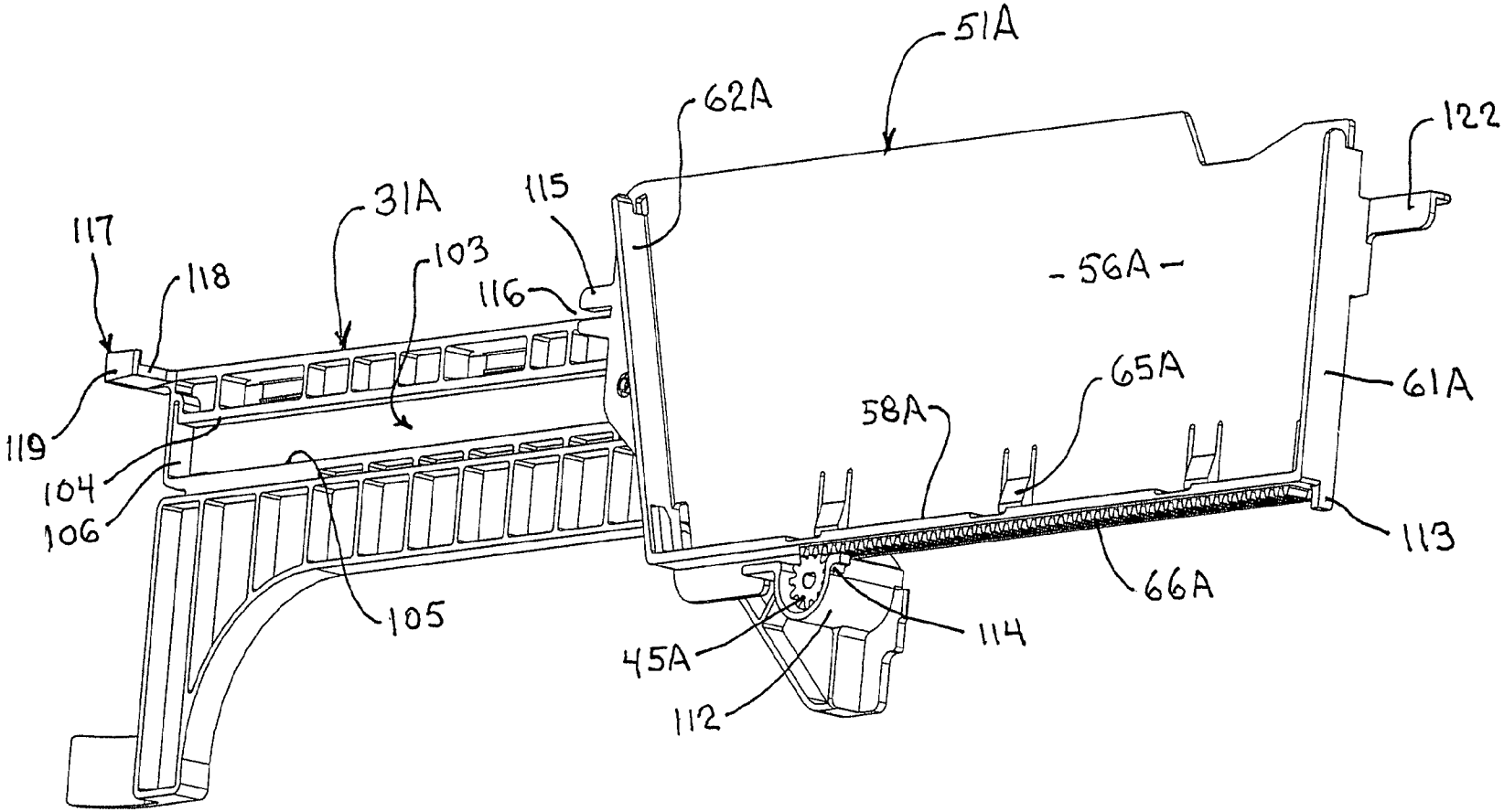
FIG. 28 is a perspective view similar to FIG. 27 but showing the support panel in its open or extended position relative to the mounting panel.
Figure 29:
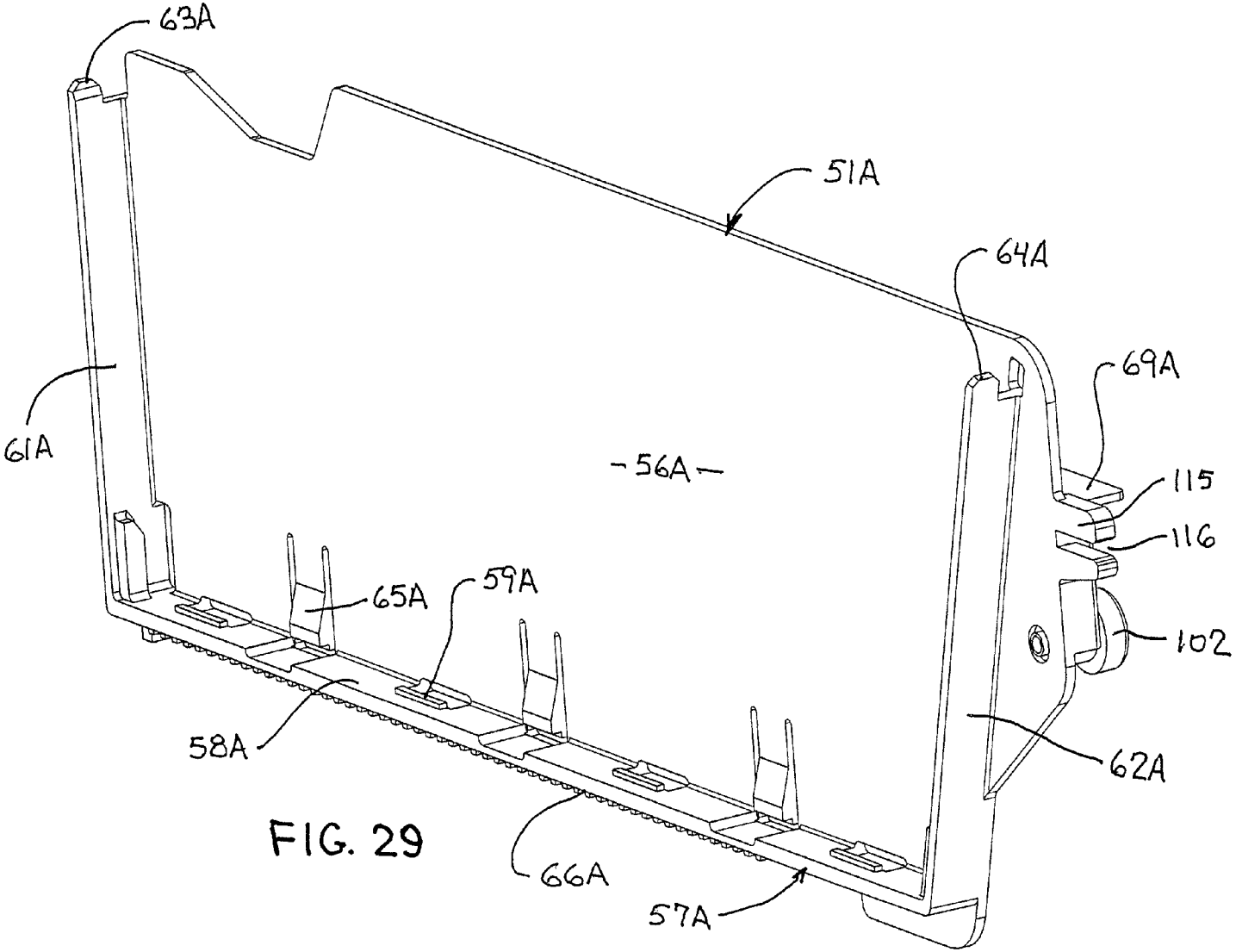
FIG. 29 is a perspective view of solely the inner support panel and showing the inner side thereof.
Figure 30:
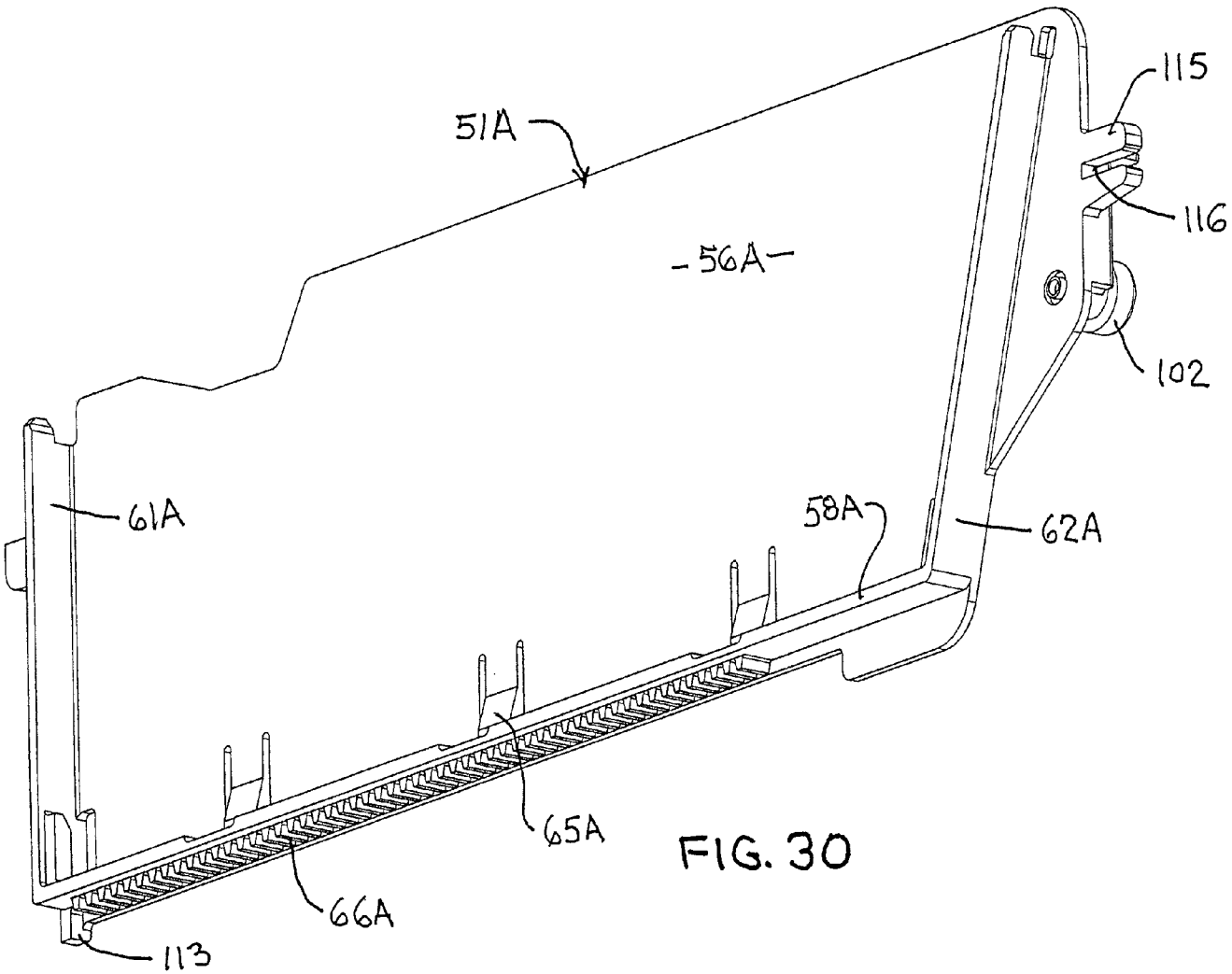
FIG. 30 is a perspective view similar to FIG. 29 but taken from a slightly different orientation.

As illustrated by FIGS. 28 and 31, each of the support panels 51A is also preferably provided with a finger-like projection 122 which is horizontally cantilevered outwardly a selected distance beyond the rear edge of the panel member. The finger-like projection 122 in the illustrated embodiment is formed generally as an extension of the rail 69A. The finger-like projections 122 are provided and dimensioned so as to protrude outwardly a sufficient extent to permit contact with a rear wall of the cabinet when the existing cabinet drawer, with the insert arrangement mounted thereon, is being closed to insure that the insert drawer arrangement 28A always moves back into its fully forward position on the mounting panels 31A when the existing drawer reaches its fully closed position.

In this embodiment, the side walls 33A associated with the mounting panels 31A, over a substantial extent thereof, is of reduced vertical height so as to minimize the usage of material, but the side wall adjacent the front and rear edges thereof is provided with leg-like extensions 46A and 47A projecting vertically downwardly. These leg-like projections project downwardly so that each terminates in a bottom surface, which surfaces on the front and rear leg parts 46A and 47A are generally coplanar. These leg parts, however, do not project downwardly a sufficient extent to engage the bottom wall of the existing drawer. The front leg part 46A is provided with a deflectable stop flange or tab 123 which is positioned for contact with the front wall of the existing cabinet drawer, and a further positioning stop surface 124 is defined on the rear edge of the side wall 33A for positioning engagement with the rear wall of the cabinet drawer.

When the insert drawer arrangement 26A according to this second embodiment is provided in kit form, the kit will be composed of four principal components, the first and second components being the assembled mounting and supporting panels 31A and 51A defining the right and left sides of the overall insert arrangement, the third component being the assembled anti-racking gear-and-shaft subassembly, and the fourth component being the insert drawer member 52A. When the arrangement defined by this kit is to be assembled, the right and left panel assemblies (each defined by the adjacent panels 31A and 51A) can be disposed in spaced upright relationship on a flat surface, as permitted by the flat bottom surfaces defined on the leg parts 46A and 47A. The gear-and-shaft subassembly is positioned between the spaced panel subassemblies, and the ends of the shaft 44A are then manually inserted into the respective support hubs 43A. This latter insertion results in the respective gears 45A being engaged with the respective racks 66A. If necessary, the shaft and gears may require a small amount of rotation during the insertion process to allow the gear teeth to align with and then slide into meshing engagement with the teeth on the gear racks. Thereafter the insert drawer member 52A is positioned above the sidewardly-spaced support panels 51A, and then moved downwardly so as to create a snap-type securement of the drawer member 52A to the support panels 51A, whereby the overall insert drawer arrangement is now a one-piece assembly.

The one-piece assembly defining the insert drawer arrangement is then positioned over the box structure 15 of the cabinet drawer, which can remain attached to the cabinet, and the insert arrangement is moved downwardly and slightly rearwardly tilted so as to permit the rear portion of the insert assembly to be disposed directly over the rear of the cabinet drawer box structure. The insert assembly is then moved downwardly so that the rear stop surface 124 is positioned adjacent the front face of the rear wall 19 of the box structure, and the channel structures associated with the upper edges of the mounting panels 31A are moved downwardly so as to snap over the upper edges of the end walls 17 to hence fixedly secure the assembled insert arrangement to the box structure 15 of the existing cabinet drawer. The tape strips 121 are then removed from the adjacent flanges 34A and 69A, thereby enabling the support panel 51A to move relative to the mounting panel 31A.

Figure 35:
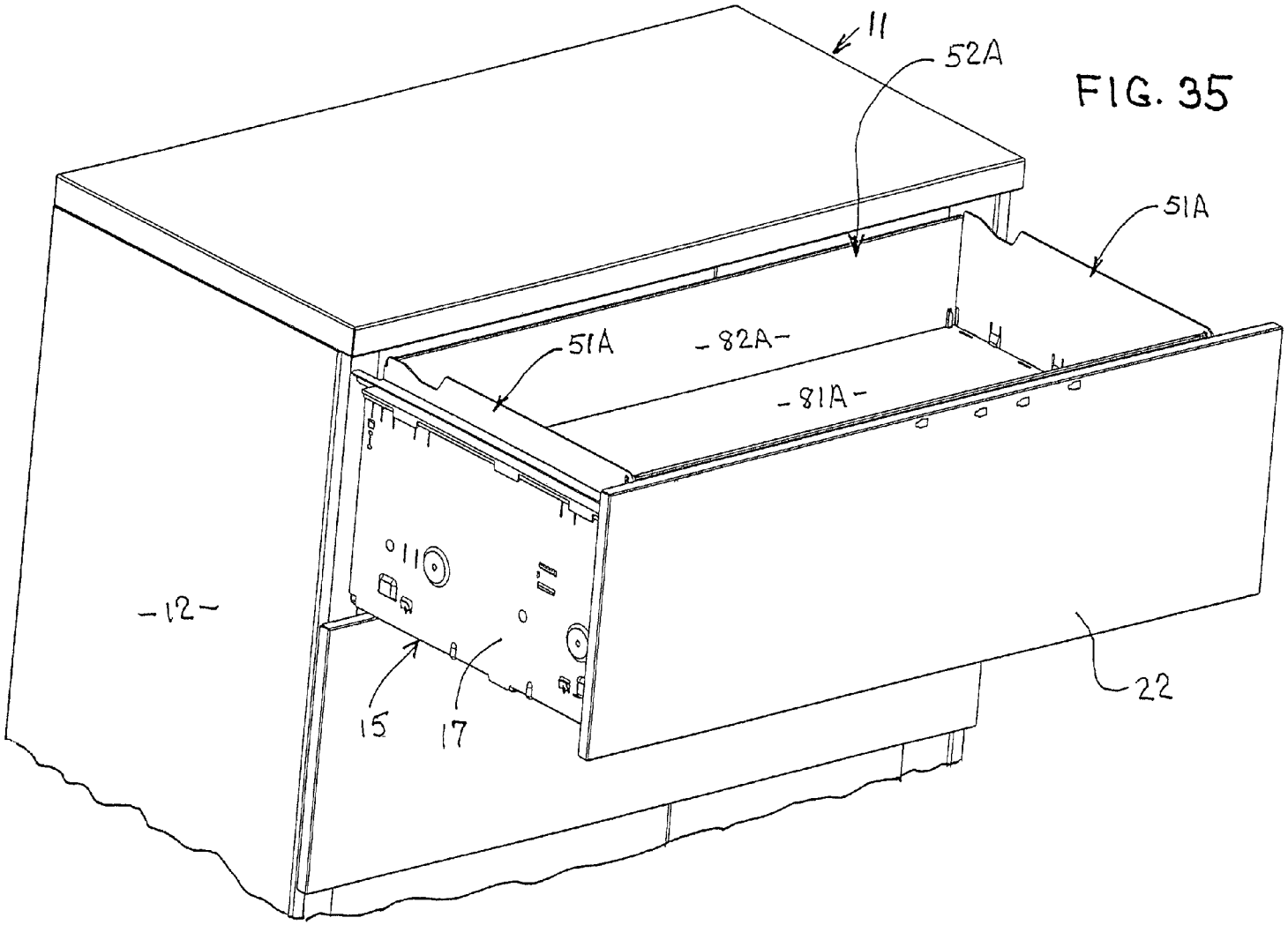
FIG. 35 is a perspective view of a conventional cabinet having a box-shaped file drawer disposed in an open condition, the latter having the insert drawer arrangement of FIGS. 21-34 mounted therein, with the insert drawer being disposed in its contracted position so that the storage compartment thereof is accessible when the existing file drawer is in its open condition.
Figure 36:
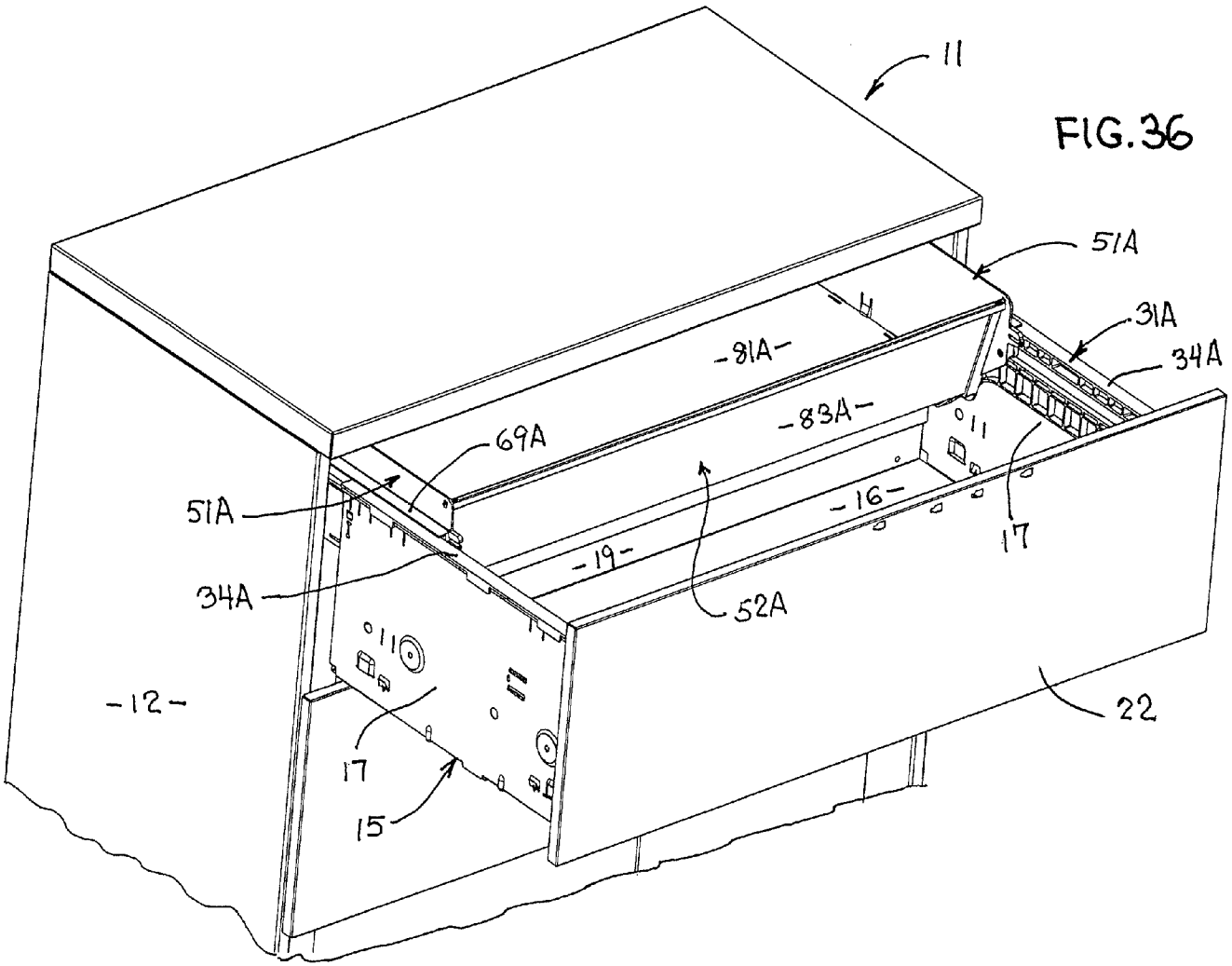
FIGS. 36 and 37 are views which generally correspond to FIG. 35 but illustrate the insert drawer manually displaced rearwardly into its extended position so as to allow access into the main storage compartment defined by the existing cabinet drawer, while at the same time permitting limited or more restrictive access to the upper storage compartment defined by the insert drawer.
Figure 37:
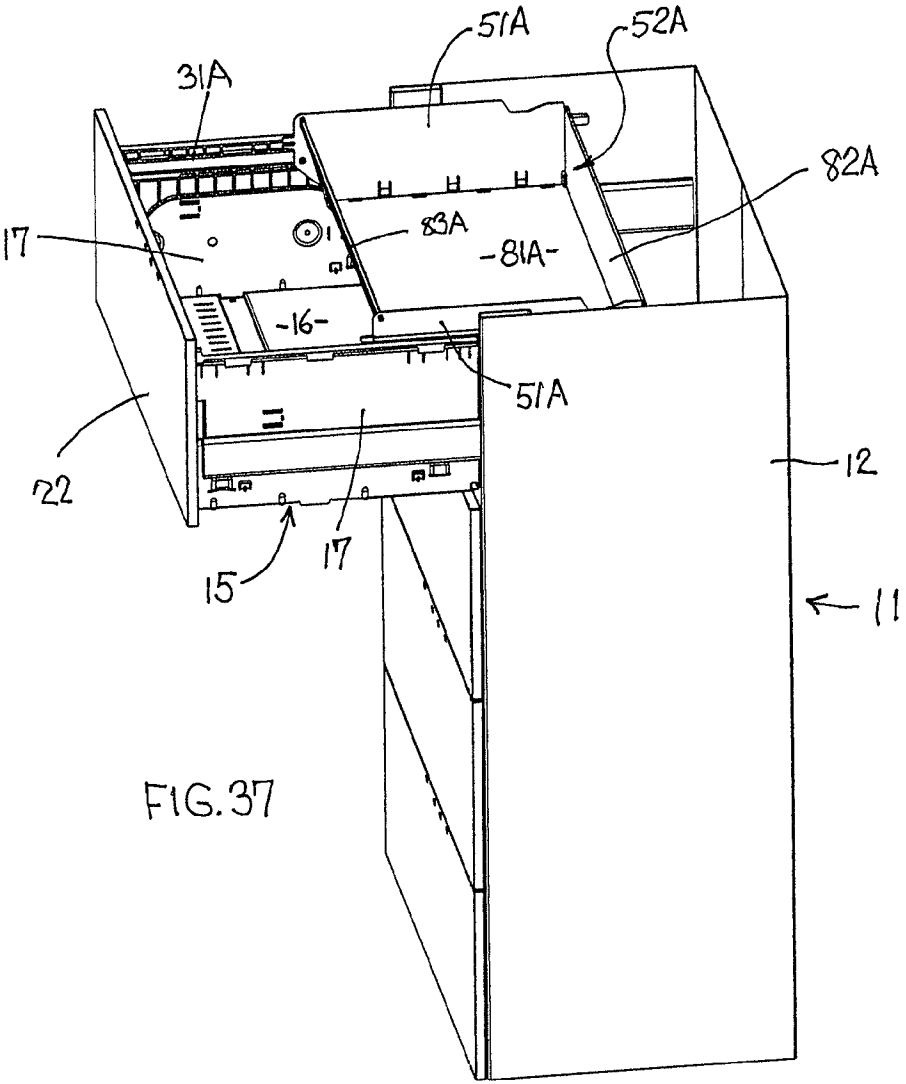

Thereafter, the existing cabinet drawer, with the insert arrangement assembled thereto, can then be moved from a closed position into an open position substantially as illustrated in FIG. 35, in which position the insert drawer storage compartment is vertically accessible. And, from this open position, the insert drawer can be manually displaced into its rearward extended position as illustrated in FIG. 36 so as to permit access to the storage compartment defined adjacent the lower portion of the existing cabinet drawer.

Although a particular preferred embodiment of the invention has been disclosed in detail for illustrative purposes, it will be recognized that variations or modifications of the disclosed apparatus, including the rearrangement of parts, lie within the scope of the present invention.

We claim:

1. A storage drawer structure, comprising:

a file cabinet comprising a housing having parallel upright side walls joined by an upright rear wall and having a drawer opening formed in an upright front side thereof, and at least one upwardly opening box-shaped drawer horizontally movably supported on said housing and movable between a closed position disposed within the housing and an open position wherein the drawer is cantilevered horizontally outwardly from said front side to permit vertical access into said drawer;

said drawer comprising a box structure which is horizontally movably supported on the housing and includes a horizontal upwardly facing bottom wall within the box structure extending between and rigidly joined to a pair of sidewardly spaced and parallel end panels which protrude upwardly and are rigidly joined by an upright rear panel disposed adjacent a rear edge of said bottom wall;

said drawer including a vertical panel-like door front for closing off the drawer opening when the drawer is in said closed position;

an insert arrangement structurally coupled to said box structure;

said insert arrangement including a pair of upright and parallel mounting panels positioned sidewardly adjacent and fixedly mounted to the respective end panels of said box structure;

said insert arrangement also including a drawer assembly having a pair of upright and parallel end members positioned sidewardly adjacent and mounted on the respective mounting panels; and an upwardly-opening insert drawer which fixedly mounts on said end members and extends horizontally therebetween, said insert drawer being disposed in upward spaced relationship from the bottom wall of said box structure;

said drawer assembly being horizontally movably supported on said support panels for movement between a contracted position wherein the insert drawer is disposed vertically directed over said bottom wall and an extended position wherein the insert drawer is cantilevered horizontally outwardly from an edge of said box structure, wherein said upwardly facing bottom wall within said box structure is exposed and accessible when said drawer assembly is in said contracted position.

2. A drawer structure according to claim 1, wherein respectively adjacent end members and mounting panels have guide structure cooperating therebetween for permitting horizontal displacement of said drawer assembly and the insert drawer carried thereon between said extended and contracted positions.

3. A drawer structure according to claim 2, wherein said guide structure includes a roller member rotatably mounted on each said end member adjacent an end edge thereof and positioned in rolling engagement with a horizontally elongate guide 36 provided on the respectively adjacent mounting panel.

4. A drawer structure according to claim 2, wherein said guide structure includes a gear mounted to mounting panels, and a gear rack disposed on said end members in meshing engagement with said gear.

5. A drawer structure according to claim 2, wherein said guide structure includes a first roller member rotatably mounted on each said mounting panel adjacent a first end edge thereof and positioned in rolling engagement with a horizontally elongate guide rail provided on the respectively adjacent end member, and a second roller member rotatably mounted on each said end member adjacent an edge thereof and rollingly engaged with a horizontally elongate guide associated with the respectively adjacent mounting panel.

6. A drawer structure according to claim 1, including a releasable detent structure cooperating between each said mounting panel and the respectively adjacent said end panel for releasably but stationarily mounting said insert arrangement to said box structure.

7. A storage drawer structure, comprising:

a file cabinet comprising a housing having parallel upright side walls joined by an upright rear wall and having a drawer opening formed in an upright front side thereof, and at least one upwardly opening box-shaped drawer horizontally movably supported on said housing and movable between a closed position disposed within the housing and an open position wherein the drawer is cantilevered horizontally outwardly from said front side to permit vertical access into said drawer, said box-shaped drawer having an upwardly facing bottom wall within said drawer;

said drawer including a vertical panel-like door front for closing off the drawer opening when the drawer is in said closed position;

a drawer insert arrangement retroactively fixedly attached to said box-shaped drawer and defining a secondary drawer disposed in upwardly spaced relation from said bottom wall of said box-shaped drawer;

said drawer insert arrangement including right and left upright mounting panels positioned sidewardly adjacent and in generally overlapping relation to adjacent inner side surfaces of respective right and left end panels of said box-shaped drawer;

said drawer insert arrangement also including said secondary drawer defined by right and left end members joined to opposite ends of an upward-opening channel-shaped drawer member; and said right and left end members positioned sidewardly adjacent said respective right and left mounting panels and movably supported thereon by cooperating guide structure which permits the secondary drawer to be horizontally movable between (1) a contracted position wherein the secondary drawer is disposed within the box-shaped drawer in upwardly spaced relation from said bottom wall and (2) an extended position wherein the secondary drawer is cantilevered horizontally outwardly beyond an upper edge of a rear wall of said box-shaped drawer, wherein said upwardly facing bottom wall of said box-shaped drawer is exposed and accessible when said insert arrangement is mounted on said box structure.

8. A storage drawer structure, comprising:

a file cabinet comprising a housing defining an interior which extends between upright side walls and accessible through an opening formed in an upright front side thereof, and at least one upwardly opening box-shaped cabinet drawer horizontally movably supported on the housing and movable between a closed position disposed within the housing and an open position wherein the cabinet drawer is cantilevered horizontally outwardly from the front side of the housing to permit vertical access into said cabinet drawer;

said cabinet drawer comprising an upwardly-opening box structure which is horizontally movably supported on the housing and includes a horizontal upwardly facing bottom wall within the box structure extending between and rigidly joined to a pair of sidewardly spaced and parallel end walls which protrude upwardly and are rigidly joined by an upright rear wall, the box structure defining therein an upwardly-opening primary storage compartment as defined above said bottom wall;

the box structure defining said cabinet drawer having a front wall which closes said front opening when the cabinet drawer is in said closed position, and said rear wall having a height which is less than the height of said front wall;

an insert arrangement mounted on said box structure and defining an upwardly-opening secondary storage compartment which is disposed in upwardly spaced relation from the bottom wall of said box structure;

said insert arrangement including right and left mounting members which fixedly attach to said right and left end walls respectively, and an insert drawer which includes right and left support panels which effect closure of the right and left sides of the secondary storage compartment and are disposed sidewardly adjacent and horizontally movably mounted on the right and left mounting members, respectively, said insert drawer being horizontally movable between a retracted position wherein the insert drawer is disposed directly over the bottom wall and within a vertical envelope defined by said box structure with a bottom wall of the insert drawer being spaced upwardly from the bottom wall of the box structure to define said primary storage compartment vertically therebetween, and an extended position wherein the insert drawer is horizontally displaced rearwardly away from said front wall and is cantilevered outwardly from said rear wall into the interior of said cabinet to permit free access to the primary storage compartment, wherein said upwardly facing bottom wall within said box structure is exposed and accessible when said insert drawer is in said retracted position.

9. A drawer structure according to claim 8, wherein each mounting member includes a downwardly-opening channel structure which extends horizontally thereof in a front-to-back direction and which engages downwardly over an upper edge of the respective end wall of the box structure to effect stationary securement of the mounting member thereto in a manner which is free of separate fasteners.

10. A drawer structure according to claim 9, wherein the mounting members and the respectively engaged support panels of the insert drawer have front-to-rear extending guide structure cooperating therebetween and defining a horizontally elongate guide rail arrangement cooperating with rollers for enabling the insert drawer to be horizontally displaced between said retracted and extended positions.

11. A drawer structure according to claim 8, including an anti-racking gear rotatably supported on each mounting member adjacent a rearward end thereof, and an anti-racking shaft extending horizontally between said mounting members and non-rotatably coupled to the anti-racking gears supported thereon, and said insert drawer having horizontally elongate gear racks formed on the support panels thereof and positioned in meshing engagement with the respective anti-racking gears for controlling horizontal movement of the insert drawer between said retracted and extended positions.

12. A drawer structure according to claim 8, wherein an anti-racking gear is rotatably supported on each said mounting member adjacent a lower rear corner thereof in proximity to an inner side thereof, each said gear being disposed below and in meshing engagement with a down-facing gear rack which is formed on the respectively adjacent support panel and which extends horizontally in a front-to-back direction of the support panel, and a horizontally elongate shaft extending between and being non-rotatably and coaxially joined to said gears.

13. A drawer structure according to claim 12, wherein said mounting member has a shield structure fixed to and cantilevered outwardly away from an inner side surface thereof adjacent the lower rear corner thereof, said shield structure having a semi-cylindrical configuration disposed adjacent and extending generally around a lower half of the adjacent respective gear.

14. A drawer structure according to claim 8, including a positioning finger fixed to each said support panel and cantilevered rearwardly beyond a rear edge of said support panel, whereby the positioning finger contacts the rear wall of the cabinet housing when the cabinet drawer moves into the closed position to cause the insert drawer to be moved into the retracted position.

15. A drawer structure according to claim 8, wherein each said mounting member comprises a one-piece upright panel having a downward-opening channel structure adjacent an upper edge thereof for creating a resilient engagement with an upper edge of said end wall so as to support the mounting member adjacent an inner side surface of said end wall in overlapping relation therewith, and wherein each said support panel is a one-piece upright panel-like member positioned sidewardly adjacent an inner side of said mounting member.

16. A storage drawer structure, comprising:

a file cabinet comprising a housing defining an interior which extends between upright side walls and accessible through an opening formed in an upright front side thereof, and at least one upwardly opening box-shaped cabinet drawer horizontally movably supported on the housing and movable between a closed position disposed within the housing and an open position wherein the cabinet drawer is cantilevered horizontally outwardly from the front side of the housing to permit vertical access into said cabinet drawer;

said cabinet drawer comprising an upwardly-opening box structure which is horizontally movably supported on the housing and includes a horizontal bottom wall extending between and rigidly joined to a pair of sidewardly spaced and parallel end walls which protrude upwardly and are rigidly joined by an upright rear wall, the box structure defining therein an upwardly-opening primary storage compartment as defined above said bottom wall;

the box structure defining said cabinet drawer having a front wall which closes said front opening when the cabinet drawer is in said closed position, and said rear wall having a height which is less than the height of said front wall;

an insert arrangement mounted on said box structure and defining an upwardly-opening secondary storage compartment which is disposed in upwardly spaced relation from the bottom wall of said box structure;

said insert arrangement including right and left mounting members which fixedly attach to said right and left end walls respectively, and an insert drawer which includes right and left support panels which effect closure of the right and left sides of the secondary storage compartment and are disposed sidewardly adjacent and horizontally movably mounted on the right and left mounting members, respectively, said insert drawer being horizontally movable between a retracted position wherein the insert drawer is disposed directly over the bottom wall and within a vertical envelope defined by said box structure with a bottom wall of the insert drawer being spaced upwardly from the bottom wall of the box structure to define said primary storage compartment vertically therebetween, and an extended position wherein the insert drawer is horizontally displaced rearwardly away from said front wall and is cantilevered outwardly from said rear wall into the interior of said cabinet to permit free access to the primary storage compartment, wherein the respective sidewardly-adjacent mounting member and support panel have cooperating overlapping side stop members adjacent both front and rear edges thereof for preventing sideward separation therebetween when the respective mounting member and support panel are positioned relative to one another corresponding to said retracted position.

* * * * *

UNITED STATES PATENT AND TRADEMARK OFFICE

CERTIFICATE OF CORRECTION

PATENT NO. : 8,708,435 B2
APPLICATION NO. : 13/343404
DATED : April 29, 2014
INVENTOR(S) : Ross Johnson et al.

It is certified that error appears in the above-identified patent and that said Letters Patent is hereby corrected as shown below:

On the Title Page
In the Abstract item (57), Line 10:
"drawing" should be -- drawer --

Signed and Sealed this
Twenty-ninth Day of July, 2014

Michelle K. Lee

Michelle K. Lee
*Deputy Director of the United States Patent and Trademark Office*